US009188886B2

(12) United States Patent
Hirose et al.

(10) Patent No.: US 9,188,886 B2
(45) Date of Patent: Nov. 17, 2015

(54) IMAGE HOLDING MEMBER FOR IMAGE FORMING APPARATUS, PROCESS CARTRIDGE, AND IMAGE FORMING APPARATUS

(71) Applicant: FUJI XEROX CO., LTD., Tokyo (JP)

(72) Inventors: Hidekazu Hirose, Kanagawa (JP); Ryosaku Igarashi, Kanagawa (JP); Katsuhiro Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/255,350

(22) Filed: Apr. 17, 2014

(65) Prior Publication Data

US 2014/0227005 A1 Aug. 14, 2014

Related U.S. Application Data

(62) Division of application No. 13/469,606, filed on May 11, 2012, now Pat. No. 8,741,515.

(30) Foreign Application Priority Data

Dec. 22, 2011 (JP) ..... 2011-282340

(51) Int. Cl.

| | |
|---|---|
| ***G03G 5/06*** | (2006.01) |
| ***G03G 15/01*** | (2006.01) |
| ***G03G 5/07*** | (2006.01) |
| ***G03G 21/18*** | (2006.01) |

(52) U.S. Cl.

CPC ..... *G03G 5/0661* (2013.01); *G03G 5/0614* (2013.01); *G03G 5/0648* (2013.01); *G03G 5/076* (2013.01); *G03G 15/0142* (2013.01); *G03G 21/18* (2013.01)

(58) Field of Classification Search

CPC . G03G 5/0614; G03G 5/0648; G03G 5/0661; G03G 5/056; G03G 15/0142; G03G 21/18

USPC ..... 430/96; 399/111, 159

See application file for complete search history.

(56) References Cited

U.S. PATENT DOCUMENTS

| | | | | |
|---|---|---|---|---|
| 4,047,948 | A | 9/1977 | Horgan | |
| 4,299,897 | A | 11/1981 | Stolka et al. | |
| 7,455,916 | B2 * | 11/2008 | Hirose et al. | 313/504 |
| 2004/0018384 | A1 | 1/2004 | Hirose et al. | |
| 2005/0033011 | A1 | 2/2005 | Seki et al. | |
| 2006/0046094 | A1 | 3/2006 | Nishino et al. | |
| 2011/0086999 | A1 | 4/2011 | Hirose et al. | |
| 2011/0207040 | A1 | 8/2011 | Hirose et al. | |

FOREIGN PATENT DOCUMENTS

| | | |
|---|---|---|
| DE | 3703495 A1 * | 8/1988 |
| JP | A-61-132955 | 6/1986 |
| JP | A-62-267749 | 11/1987 |
| JP | A-03-138654 | 6/1991 |

OTHER PUBLICATIONS

English language machine translation of DE 3703495 (Aug. 1988).*

* cited by examiner

*Primary Examiner* — Christopher Rodee

(74) *Attorney, Agent, or Firm* — Oliff PLC

(57) ABSTRACT

An image holding member for an image forming apparatus includes a support and a photosensitive layer disposed on the support. The photosensitive layer contains a charge generating material and a compound represented by the following formula (II-1):

Formula (II-1)

wherein in the formula (II-1), $Y^1$'s each independently represent a substituted or unsubstituted divalent hydrocarbon group; $A^1$ represents a group represented by formula (II-2); $R^2$'s each independently represent a hydrogen atom, an alkyl group, a substituted or unsubstituted aryl group, or a substituted or unsubstituted aralkyl group; m's each independently represent an integer of from 1 to 5; and p represents an integer of from 5 to 5,000.

12 Claims, 5 Drawing Sheets

IMAGE HOLDING MEMBER FOR IMAGE FORMING APPARATUS, PROCESS CARTRIDGE, AND IMAGE FORMING APPARATUS

CROSS-REFERENCE TO RELATED APPLICATIONS

This application is a divisional application of U.S. patent application Ser. No. 13/469,606 filed on May 11, 2012, which claims priority to Japanese Patent Application No. 2011-282340 filed on Dec. 22, 2011. The disclosure of the prior applications is hereby incorporated by reference herein in its entirety.

BACKGROUND

1. Technical Field

The present invention relates to an image holding member for an image forming apparatus, a process cartridge, and an image forming apparatus.

2. Related Art

A photoreceptor having a photosensitive layer which contains an organic photoconductive compound as a principal component has many advantages such as relatively easy manufacturability, low price, easy handleability, and excellent thermal stability, as compared with photoreceptors containing inorganic photoconductors used in the related art (selenium, zinc oxide, cadmium sulfide, silicon and the like) as principal components. Thus, active investigations have been conducted thereon.

Particularly, photoreceptors having a functionally separable, laminate type photosensitive layer, in which the charge generation function and the charge transport function of the photoconductor are respectively assigned to separate functional layers, and a material having the former generation function is incorporated into a charge generating layer, while a material having the latter transport function is incorporated into a charge transport layer, have already been put to practical use.

SUMMARY

According to an aspect of the present invention, there is provided an image holding member for an image forming apparatus including a support, and a photosensitive layer disposed on the support and containing a compound represented by the following formula (I):

a substituted or unsubstituted monovalent polynuclear aromatic hydrocarbon group having two aromatic rings, a substituted or unsubstituted monovalent condensed aromatic hydrocarbon group having two or three aromatic rings, or a substituted or unsubstituted monovalent aromatic heterocyclic group; and n's each independently represent a number of from 0 to 7.

BRIEF DESCRIPTION OF THE DRAWINGS

Exemplary embodiments of the present invention will be described in detail based on the following figures, wherein.

DETAILED DESCRIPTION

Figure 1:
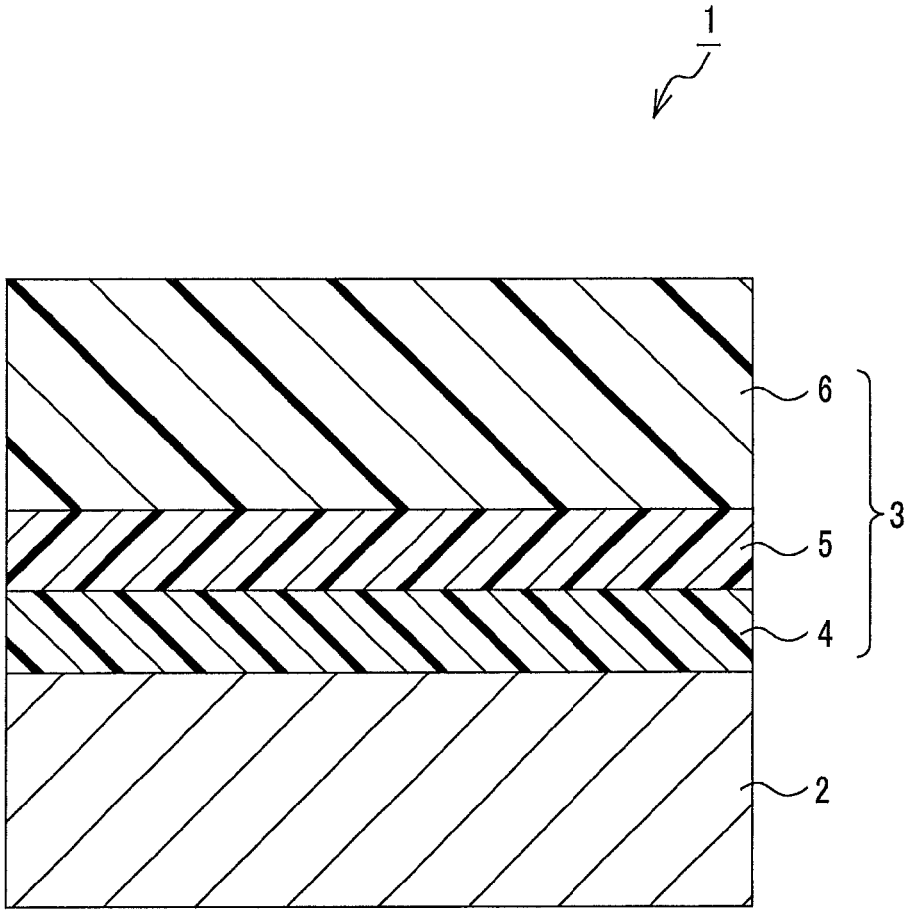
FIG. 1 is a schematic cross-sectional view of the image holding member for an image forming apparatus related to a first exemplary embodiment.

Hereinafter, exemplary embodiments of the present invention will be described.

In the exemplary embodiment of the present invention, there is provided an image holding member for an image forming apparatus, which uses at least one of a compound represented by the following formula (I) and a compound represented by the following formula (II-1) as a charge transporting material. That is, the image holding member is an image holding member for an image forming apparatus, in which a photosensitive layer is formed on a support (for example, a conductive support), and the photosensitive layer contains at least one of a compound represented by the following formula (I) and a compound represented by the following formula (II-1).

Meanwhile, the conductive support according to the exemplary embodiment refers to a support having a volume resistivity of the surface of less than $10^7$ Ω·cm as measured based on JIS K 7194 "Testing method for resistivity of conductive plastics with a four-point probe array". That is, the conductive support may be a support formed of a conductive material

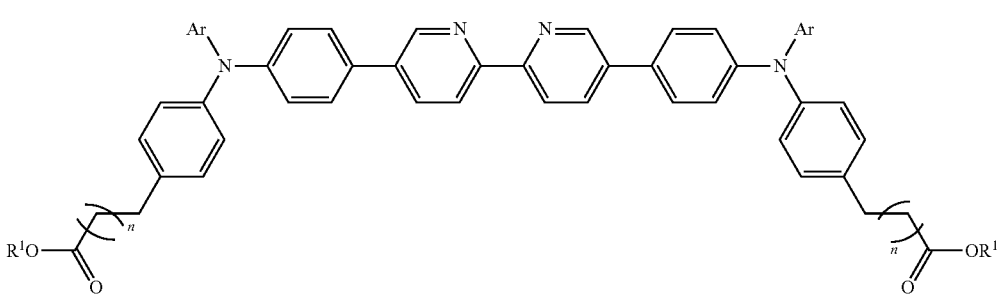

(I)

wherein in the formula (I), $R^1$'s each independently represent a substituted or unsubstituted linear or branched alkyl group having from 1 to 8 carbon atoms; Ar's each independently represent a substituted or unsubstituted phenyl group, having a volume resistivity measured based on the above-described method of less than $10^7$ Ω·cm, or may be a support having a conductive layer formed of the conductive material on the base material surface.

The photosensitive layer in the image holding member for an image forming apparatus may be any of a single-layer type photosensitive layer containing a charge generating material and a charge transporting material in the same layer, and a functionally separated photosensitive layer in which a layer containing the charge generating material and a layer containing the charge transporting material are provided separately but adjacently to each other. As the charge transporting material, at least one of a compound represented by the following formula (I) and a compound represented by the following formula (II-1) is incorporated.

Furthermore, the image holding member for an image forming apparatus may include a protective layer on the outermost surface (farthest position from the conductive support), and the protective layer in this case preferably contains a crosslinkable silicone resin having charge transporting properties.

(Image Holding Member for Image Forming Apparatus)

The image holding member for an image forming apparatus related to the exemplary embodiment is an image holding member for an image forming apparatus in which a photosensitive layer containing at least one of a compound represented by the following formula (I) and a compound represented by the following formula (II-1) is formed on a support.

<Compound Represented by Formula (I)>

Hereinafter, the compound represented by the following formula (I) will be described in detail.

The heterocyclic group as the substituent means a group having a ring containing elements other than carbon and hydrogen (that is, a heterocyclic ring). The heterocyclic ring is preferably such that the number of atoms constituting the ring skeleton (Nr) is 5 or 6. The type and number of the atoms other than carbon atoms constituting the ring skeleton (heteroatoms) are not particularly limited, but for example, sulfur atoms, nitrogen atoms, oxygen atoms, selenium atoms, silicon atoms, and phosphorus atoms are preferably used. The ring skeleton may contain two or more kinds of heteroatoms, or may also contain two or more heteroatoms.

As a 5-membered heterocyclic ring, for example, thiophene, pyrrole, furan, imidazole, oxazole, selenophene, thiazole, thiadiazole, pyrazole, isoxazole, isothiazole, silole, or a heterocyclic ring in which the carbon atoms at the 3-position and the 4-position of one of the above-described compounds have been replaced by nitrogen atoms, is preferably used. Other examples of an aromatic heterocyclic ring having a 5-membered heterocyclic ring include benzothiophene, benzimidazole, and indole.

As a 6-membered heterocyclic ring, pyridine, pyrimidine, pyrazine or piperazine is preferably used.

Meanwhile, the heterocyclic group as the substituent encompasses a group in which the heterocyclic ring is substituted with an aromatic ring, and also encompasses a group in which an aromatic ring is substituted with a heterocyclic ring.

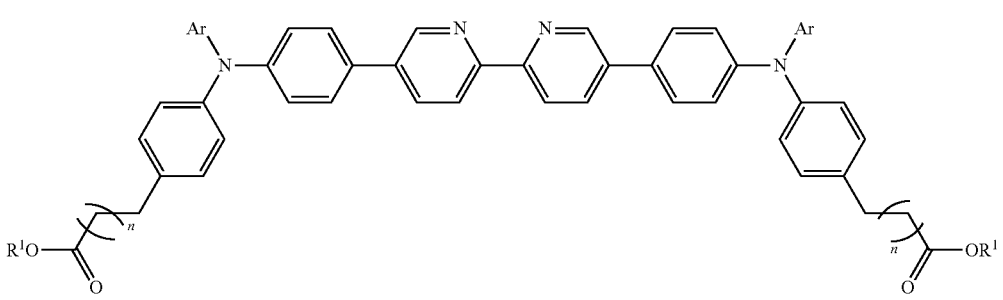

(I)

In the formula (I), $R^1$'s each independently represent a substituted or unsubstituted, linear or branched alkyl group having from 1 to 8 carbon atoms; Ar's each independently represent a substituted or unsubstituted phenyl group, a substituted or unsubstituted monovalent polynuclear aromatic hydrocarbon group having two aromatic rings, a substituted or unsubstituted monovalent condensed aromatic hydrocarbon group having two or three aromatic rings, or a substituted or unsubstituted monovalent aromatic heterocyclic group; and n's each independently represent a number of from 0 to 7.

$R^1$ in the formula (I) will be explained.

As described above, $R^1$'s in the formula (I) each independently represent a substituted or unsubstituted, linear or branched alkyl group having from 1 to 8 carbon atoms.

The alkyl groups represented by $R^1$'s each independently have preferably from 1 to 6 carbon atoms, and more preferably from 1 to 4 carbon atoms.

The alkyl group represented by $R^1$ is linear or branched, and from the viewpoints of maintaining crystallinity and solubility, the alkyl group is preferably a linear alkyl group.

In the formula (I), when the alkyl group represented by $R^1$ has a substituent, the substituent may be an aryl group or a heterocyclic group.

The aryl group as the substituent preferably has from 6 to 20 carbon atoms, and examples thereof include a phenyl group, a toluyl group, and a naphthyl group.

Specific examples of the alkyl group represented by $R^1$ in the formula (I) include a methyl group, an ethyl group, a propyl group, an n-butyl group, a t-butyl group, an n-hexyl group, and an n-octyl group. The alkyl group is preferably a methyl group, an ethyl group, a propyl group, an n-butyl group, a t-butyl group, an n-hexyl group or an n-octyl group, and more preferably a methyl group or a butyl group. When the alkyl group is a methyl group or a butyl group, it is more desirable from the viewpoints of the ease of preparation and the maintenance of crystallinity, and a methyl group is even more desirable from the viewpoint of easy availability.

Furthermore, $R^1$ may be a substituted or unsubstituted, linear or branched alkyl group having from 1 to 8 carbon atoms, and within this range, the influence of the difference in the type of the alkyl group on the ionization potential or charge transportability is small.

Furthermore, the plural $R^1$'s in the formula (I) may be identical with or different from each other, but from the viewpoint of preparation, it is preferable that $R^1$'s be identical.

Ar in the formula (I) will be described

In the formula (I), Ar's each independently represent a substituted or unsubstituted phenyl group, a substituted or unsubstituted monovalent polynuclear aromatic hydrocarbon group having two aromatic rings, a substituted or unsubstituted monovalent condensed aromatic hydrocarbon group having two or three aromatic rings, or a substituted or unsubstituted monovalent aromatic heterocyclic group.

Meanwhile, the two Ar's present in the formula (I) may be identical with or different from each other, but preparation is easier when Ar's are identical.

Here, the polynuclear aromatic hydrocarbon group and the condensed aromatic hydrocarbon group according to the exemplary embodiment specifically mean groups having polycyclic aromatic rings that are defined below (that is, a polynuclear aromatic hydrocarbon or a condensed aromatic hydrocarbon).

That is, the "polynuclear aromatic hydrocarbon" represents a hydrocarbon in which two or more aromatic rings composed of carbon and hydrogen are present, and the rings are bonded by a carbon-carbon bond. A specific example is biphenyl. Furthermore, the "condensed aromatic hydrocarbon" represents a hydrocarbon compound in which two or more aromatic rings composed of carbon and hydrogen are present, and these aromatic rings share a pair of carbon atoms that are adjacently bonded to each other. Specific examples include naphthalene, anthracene, phenanthrene, and fluorene.

Furthermore, in the formula (I), the aromatic heterocyclic group selected as a structure representing Ar according to the exemplary embodiment means a group having an aromatic heterocyclic ring such as defined below.

That is, the "aromatic heterocyclic ring" represents an aromatic ring containing elements in addition to carbon and hydrogen, and for example, at least any aromatic heterocyclic ring in which the number of atoms constituting the ring skeleton (Nr) is 5 or 6 may be used. Furthermore, the type and number of the atoms that constitute the ring skeleton other than carbon atoms (heteroatoms) are not particularly limited, but for example, sulfur atoms, nitrogen atoms, and oxygen atoms are used. In the ring skeleton, at least any of two or more kinds of heteroatoms, and two or more heteroatoms may be included. Particularly, as a heterocyclic ring having a 5-membered ring structure, for example, thiophene, pyrrole, furan, or a heterocyclic ring in which the carbon atoms at the 3-position and the 4-position of any one of the above-described compounds have been replaced by nitrogen atoms is used. As a heterocyclic ring having a 6-membered ring structure, for example, pyridine is used.

Also, the aromatic heterocyclic group desirably has the aromatic heterocyclic ring described above, and may also include, in addition to a group composed of the aromatic heterocyclic ring described above, any of a group in which an aromatic ring is substituted with the aromatic heterocyclic ring, and a group in which the aromatic heterocyclic ring is substituted with an aromatic ring. Specific examples of the aromatic ring include the aromatic rings described above.

That is, the aromatic heterocyclic group may be, for example, a group in which one or more aromatic rings in the polycyclic aromatic ring described above (that is, the monovalent polynuclear aromatic hydrocarbon having two or more aromatic rings, or the monovalent condensed aromatic hydrocarbon having two or more aromatic rings) have been replaced by an aromatic heterocyclic ring(s), and specific examples include a thiophenylphenyl group, a phenylpyridine group, and a phenylpyrrole group.

In the formula (I), examples of the substituent which further substitutes the phenyl group, polynuclear aromatic hydrocarbon group, condensed aromatic hydrocarbon group or aromatic heterocyclic group represented by Ar, include a hydrogen atom, an alkyl group, an alkoxy group, an aryl group, an aralkyl group, a substituted amino group, and a halogen atom.

The alkyl group may be, for example, an alkyl group having from 1 to 10 carbon atoms, and examples thereof include a methyl group, an ethyl group, a propyl group, and an isopropyl group.

The alkoxy group may be, for example, an alkoxy group having from 1 to 10 carbon atoms, and examples thereof include a methoxy group, an ethoxy group, a propoxy group and an isopropoxy group.

The aryl group may be, for example, an aryl group having from 6 to 20 carbon atoms, and examples thereof include a phenyl group, and a toluyl group.

The aralkyl group may be, for example, an aralkyl group having from 7 to 20 carbon atoms, and examples thereof include a benzyl group and a phenethyl group.

Examples of the substituent for the substituted amino group include an alkyl group, an aryl group, and an aralkyl group, and specific examples thereof are as described above.

Among others, Ar in the formula (I) is preferably a substituted or unsubstituted phenyl group or a substituted or unsubstituted polynuclear aromatic hydrocarbon group from the viewpoints of mobility and easy handleability, more preferably a substituted or unsubstituted phenyl group or a substituted or unsubstituted polynuclear aromatic hydrocarbon group which does not contain a condensed aromatic hydrocarbon group and an aromatic heterocyclic ring, and even more preferably a substituted or unsubstituted phenyl group or a substituted or unsubstituted polynuclear aromatic hydrocarbon group in which the carbon atoms constituting the aromatic ring are directly bonded by a carbon-carbon bond.

Furthermore, the number of aromatic rings for Ar in the formula (I) is preferably from 1 to 6, more preferably from 1 to 3, and even more preferably 1 or 2, from the viewpoints of compatibility with resins and ease of synthesis. That is, Ar in the formula (I) is more preferably a substituted or unsubstituted phenyl group, a substituted or unsubstituted biphenyl group, or a substituted or unsubstituted terphenyl group, and even more preferably an unsubstituted phenyl group, an unsubstituted biphenyl group, or an unsubstituted terphenyl group.

n in the formula (I) will be described.

n's in the formula (I) are each independently a number of from 0 to 7. Two n's in the formula (I) may be identical with or different from each other, but from the viewpoint of manufacturability, it is preferable that n's be identical. It is preferable that n in the formula (I) be smaller from the viewpoint of charge transportability; however, if n is too small, the charge mobility is decreased due to the influence of the dipole moment of the carbonyl group. Therefore, n is preferably from 1 to 3, and most preferably 1.

Since the compound represented by the formula (I) has a bipyridine skeleton, it can be contemplated that the compound has satisfactory charge transportability and also satisfactory compatibility with resins.

<Method for Preparing Compound Represented by Formula (I)>

Hereinafter, the method for preparing the compound represented by the formula (I) will be specifically described.

As the method for synthesizing the compound having a bipyridine skeleton of the exemplary embodiment, for example, a method of utilizing cross-coupling biaryl synthesis may be used. Specific examples of the cross-coupling biaryl synthesis include the Suzuki reaction, the Kharasch reaction, the Negishi reaction, the Stille reaction, the Grignard reaction, and the Ullmann reaction.

For example, synthesis may be carried out as described below, but the method is not limited to this.

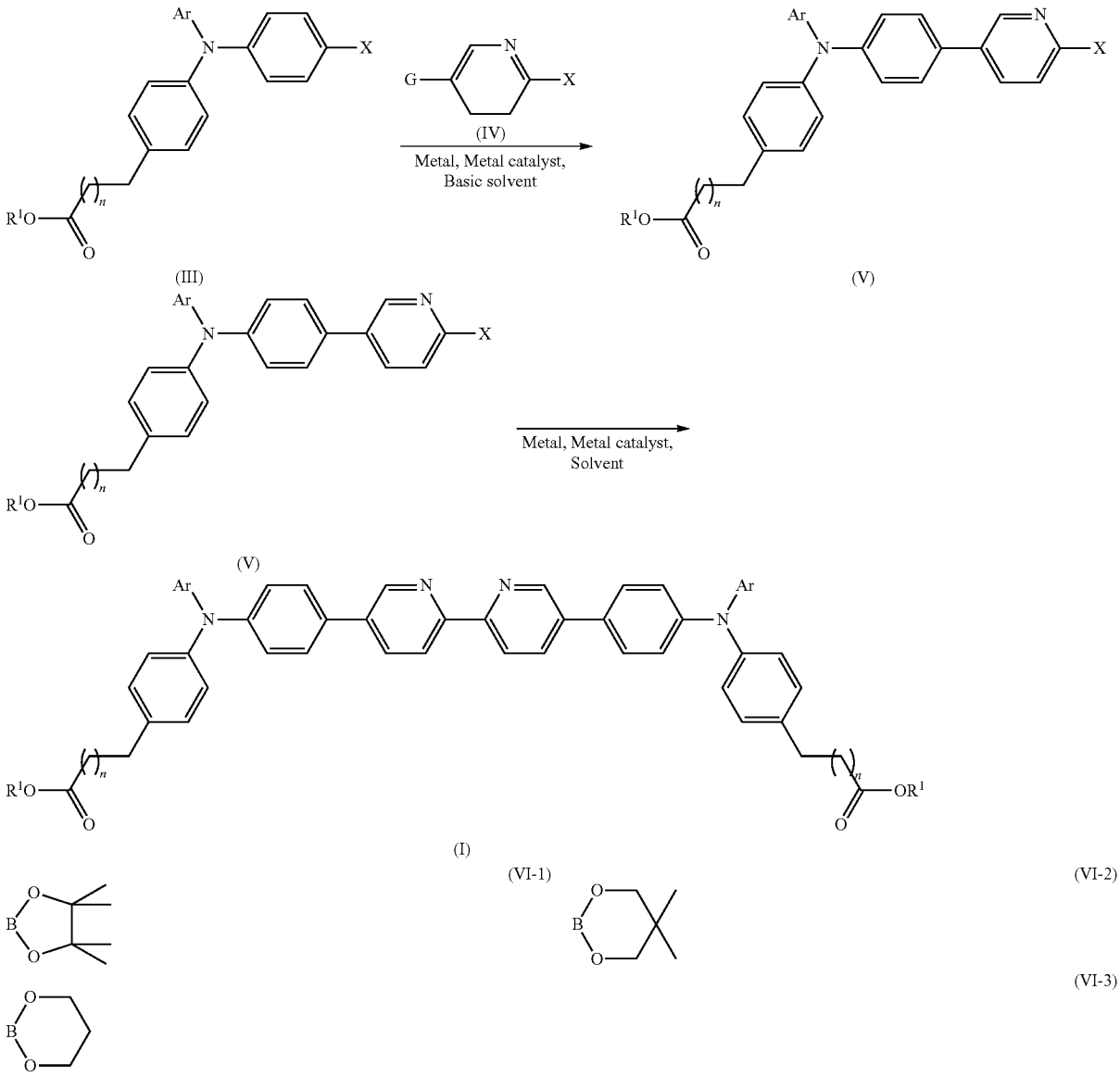

In the formula (III), formula (IV) and formula (V), X and G each independently represent a halogen atom, $B(OH)_2$, a substituent represented by the above structural formula (VI-1), a substituent represented by the above structural formula (VI-2), or a substituent represented by the above structural formula (VI-3). Furthermore, in the formula (III) and formula (V), $R^1$, n and Ar have the same meanings as $R^1$, n and Ar in the formula (I), respectively.

Also, at the time of the above-described reaction, a metal, a metal complex catalyst, a base, a solvent or the like may be used as necessary.

Furthermore, at the time of the synthesis reaction, a catalyst of a metal or a metal complex, a base, a solvent, or a co-catalyst such as an organic phosphine ligand may also be used.

As the metal, for example, palladium (Pd), copper (Cu), titanium (Ti), tin (Sn), nickel (Ni), platinum (Pt), or zinc (Zn) is used.

As the metal complex, for example, tetrakis(triphenylphosphine)palladium ($Pd(PPh_3)_4$), palladium(II) acetate ($Pd(OCOCH_3)_2$), tris(dibenzylideneacetone)dipalladium(O) ($Pd_2$ $(dba)_3$), di(triphenylphosphine)dichloropalladium ($Pd(PPh_3)_2Cl_2$) 1,1'-bis(diphenylphosphino)ferrocene-palladium(II) dichloride-dichloromethane complex ($Pd(dppf)_2Cl_2$), Pd/C, or nickel(II) acetylacetonate ($Ni(acac)_2$) is used.

As the base, for example, an inorganic base such as sodium carbonate ($Na_2CO_3$), potassium carbonate ($K_2CO_3$), cesium carbonate ($Cs_2CO_3$), orbariumhydroxide ($Ba(OH)_2$), or an organic base such as triethylamine ($NEt_3$), diisopropylamine ($NH(i\text{-}Pr)_2$), diethylamine ($NHEt_2$), dimethylamine ($NHMe_2$), trimethylamine ($NMe_3$), 1,8-diazabicyclo[5.4.0]-7-undecene (DBU), N,N-dimethyl-4-aminopyridine (DMAP), or pyridine is used.

The solvent may be any solvent which does not markedly impede the reaction, and for example, an aromatic hydrocarbon solvent such as benzene, toluene, xylene or mesitylene; an ether solvent such as diethyl ether, tetrahydofuran or dioxane; acetonitrile, dimethylformamide, dimethyl sulfoxide, methanol, ethanol, isopropyl alcohol or water is used.

Furthermore, during the reaction, for example, triphenylphosphine ($PPh_3$), tri-o-tolylphosphine ($P(o\text{-}Tol)_3$), tributylphosphine ($P(t\text{-}Bu)_3$), or triethylphosphine ($PEt_3$) is used as necessary.

Moreover, Me represents "$CH_3$"; Et represents "$C_2H_5$"; Ph represents "$C_6H_5$"; i-Pr represents "$(CH_3)_2CH_2$"; o-Tol represents "o-$CH_3C_6H_4$"; and t-Bu represents "$(CH_3)_3C$".

The reaction described above may be carried out, for example, under normal pressure in an inert gas atmosphere of nitrogen or argon, but may also be carried out under pressurized conditions.

The reaction temperature for the reaction may be, for example, in the range of from 20° C. to 300° C., but may also be in the range of from 50° C. to 180° C. The reaction time may vary with the reaction conditions, but may be selected in the range of, for example, from 5 minutes to 20 hours.

The amount of the metal or metal complex catalyst used is not particularly limited. However, for example, the amount may be in the range of from 0.001 mole to 10 moles relative to 1 mole of the compound represented by the formula (III), and may also be in the range of from 0.01 mole to 5.0 moles.

The amount of the base used may be in the range of from 0.5 mole to 4.0 moles relative to 1 mole of the compound represented by the formula (III), and may also be in the range of from 1.0 mole to 2.5 moles.

After the reaction, a crude product is obtained by, for example, introducing the reaction solution into water, subsequently stirring the mixture, and if the reaction product is in the form of crystals, collecting the crystals through suction filtration. When the reaction product is an oily substance, a crude product is obtained by, for example, extracting the reaction product with a solvent such as ethyl acetate or toluene. The crude product thus obtained may be, for example, subjected to column purification with silica gel, alumina, activated white clay or activated carbon, or may be subjected to a treatment such as adding these adsorbents to the solution and adsorbing unnecessary components. Furthermore, when the reaction product is in the form of crystals, the reaction product may also be purified by recrystallizing the crystals from a solvent such as hexane, methanol, acetone, ethanol, ethyl acetate, or toluene.

However, the synthesis method according to the exemplary embodiment is not intended to be limited to these.

As specific examples of the compound represented by the formula (I), monomer compounds 1 to 32 (compounds from Monomer Compound No. 1 to Monomer Compound No. 32 in the following Table) are shown below, but the examples are not limited to these.

Meanwhile, $R^1$, Ar and n in the Monomer Compound Nos. 1 to 32 have the same meanings as $R^1$, Ar and n in the formula (I), respectively.

| Monomer Compound No. | Ar | n | $R^1$ |
|---|---|---|---|
| 1 | 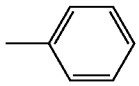 | 0 | $CH_3$ |
| 2 | 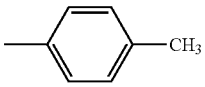 | 0 | $CH_3$ |

-continued

| Monomer Compound No. | Ar | n | $R^1$ |
|---|---|---|---|
| 3 | 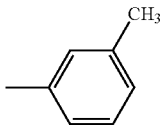 | 0 | $CH_3$ |
| 4 | 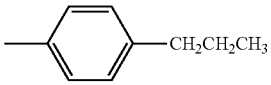 | 1 | $CH_3$ |
| 5 | 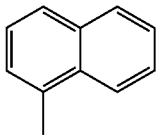 | 1 | $CH_3$ |
| 6 | 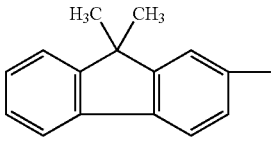 | 1 | $CH_3$ |
| 7 | 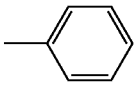 | 1 | $CH_3$ |
| 8 | 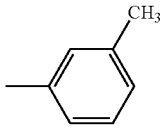 | 1 | $CH_3$ |
| 9 | 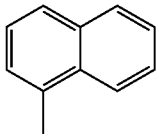 | 1 | $CH_3$ |
| 10 | 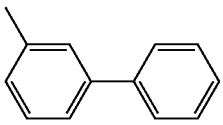 | 1 | $CH_3$ |
| 11 | 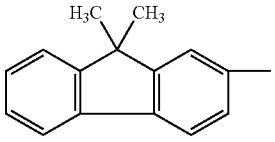 | 1 | $CH_3$ |
| 12 | 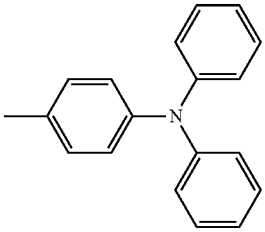 | 1 | $CH_3$ |

-continued
| Monomer Compound No. | Ar | n | $R^1$ |
|---|---|---|---|
| 13 | 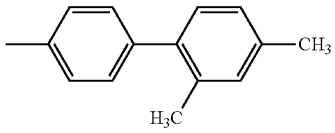 | 1 | $CH_3$ |
| 14 | 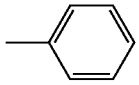 | 1 | $CH_3$ |
| 15 | 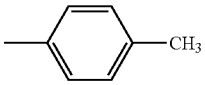 | 1 | $CH_3$ |
| 16 | 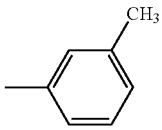 | 1 | $CH_3$ |
| 17 | 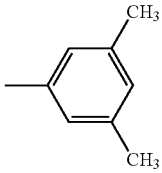 | 1 | $CH_3$ |
| 18 | 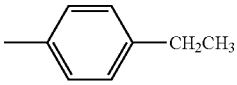 | 1 | $CH_3$ |
| 19 | 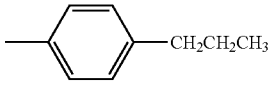 | 1 | $CH_3$ |
| 20 | 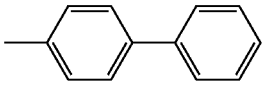 | 1 | $CH_3$ |
| 21 | 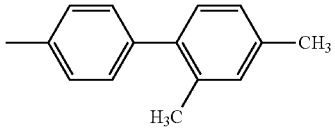 | 1 | $CH_3$ |
| 22 | 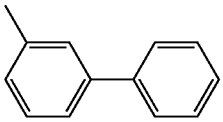 | 1 | $CH_3$ |
| 23 | 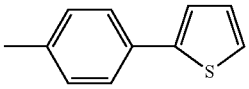 | 1 | $CH_3$ |
| 24 | 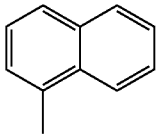 | 1 | $CH_3$ |
-continued
| Monomer Compound No. | Ar | n | $R^1$ |
|---|---|---|---|
| 25 | 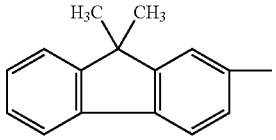 | 1 | $CH_3$ |
| 26 | 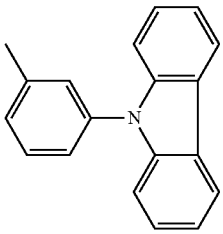 | 1 | $CH_3$ |
| 27 | 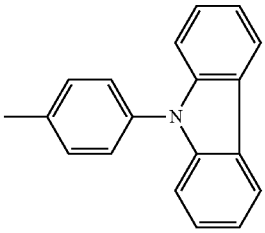 | 1 | $CH_3$ |
| 28 | 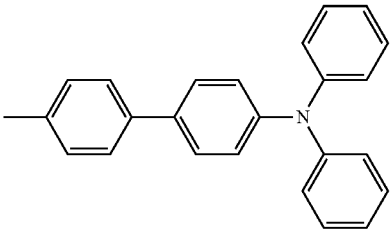 | 1 | $CH_3$ |
| 29 | 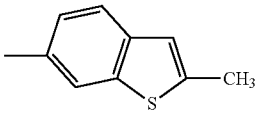 | 1 | $CH_3$ |
| 30 | 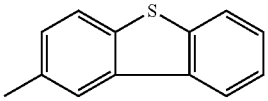 | 1 | $CH_3$ |
| 31 | 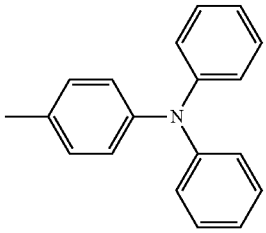 | 1 | $CH_3$ |
| 32 | 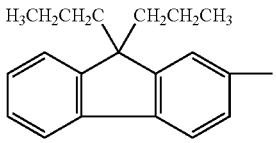 | 1 | $CH_3$ |

<Compound Containing Structural Unit Represented by Formula (II-1) (Polyester)>

The compound represented by the following formula (II-1) will be described in detail below.

Formula (II-1)

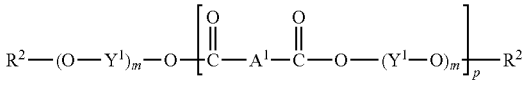

In the formula (II-1), $A^1$ represents a group represented by the following formula (II-2).

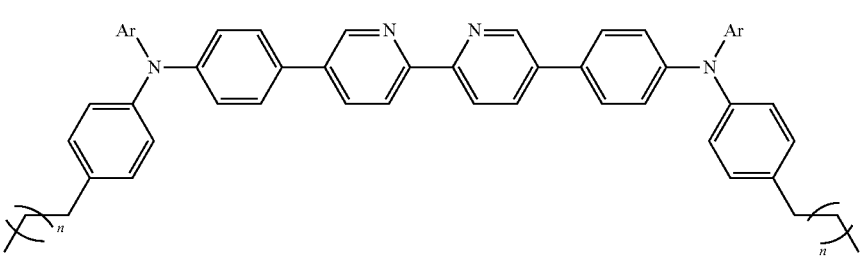

(II-2)

In the formula (II-2), Ar and n have the same meanings as Ar and n in the formula (I), respectively.

In the formula (II-1), $Y^1$'s each independently represent a substituted or unsubstituted divalent hydrocarbon group.

The divalent hydrocarbon group represented by $Y^1$ is a dihydric alcohol residue, and is preferably an alkylene group, a (poly)ethyleneoxy group, a (poly)propyleneoxy group, an arylene group, a divalent heterocyclic group, or a combination thereof.

The divalent hydrocarbon group represented by $Y^1$ is preferably a linking group with fewer carbon atoms, from the viewpoints of compatibility with resins and charge transportability. Specifically, the carbon number is preferably in the range of from 1 to 18, and more preferably in the range of from 1 to 6.

Furthermore, the divalent hydrocarbon group represented by $Y^1$ is preferably a linking group having a smaller dipole moment from the viewpoint of charge transportability. Specifically, a linking group which does not contain any atom other than carbon atoms and hydrogen atoms (for example, an oxygen atom, a nitrogen atom, or a sulfur atom) is preferable.

That is, the divalent hydrocarbon group represented by $Y^1$ is preferably an alkylene group having from 1 to 10 carbon atoms, or an arylene group having from 6 to 18 carbon atoms, and more preferably an alkylene group having from 1 to 6 carbon atoms.

Furthermore, as the divalent hydrocarbon group represented by $Y^1$, a group having smaller steric length is more preferable from the viewpoint of the compatibility with resins. Examples of the divalent hydrocarbon group having smaller steric length include a group which does not have a cyclic structure. A specific example thereof is an alkylene group having from 1 to 10 carbon atoms, and an alkylene group having from 1 to 5 carbon atoms is more preferable. Furthermore, in addition to the compatibility with resins, from the viewpoint that a polymer compound having a large molecular weight is easily synthesized, an alkylene group having 2 carbon atoms is most preferable.

Specifically, $Y^1$ in the formula (II-1) may be a group selected from groups represented by the following formula (1) to formula (8).

(1)

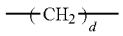

(2)

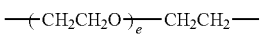

-continued (3)

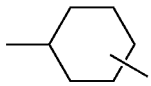

(4)

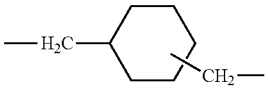

(5)

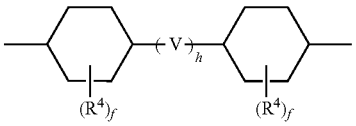

(6)

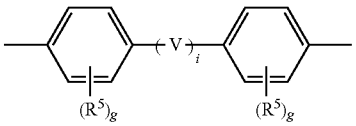

(7)

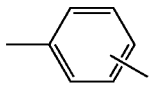

(8)

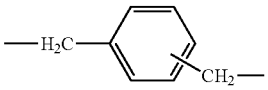

In the formulae (1) and (2), d and e each independently represent an integer of from 1 to 10.

In the formulae (5) and (6), $R^4$ and $R^5$ each independently represent an alkyl group having from 1 to 4 carbon atoms, an alkoxy group having from 1 to 4 carbon atoms, a substituted or unsubstituted phenyl group, a substituted or unsubstituted aralkyl group, or a halogen atom.

In the formulae (5) and (6), f and g each represent an integer of 0, 1 or 2; h and i each represent 0 or 1; and V represents a group selected from groups represented by the following formula (9) to formula (29).

(9) $-(CH_2)_b-$

(10) $-C(CH_3)_2-$

(11) $-O-$

(12) $-S-$

(13) $-C(CF_3)_2-$

(14) $-Si(CH_3)_2-$ (15)

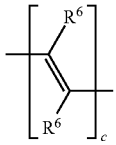

(16)

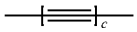

(17)

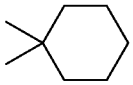

(18)

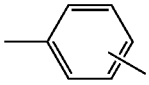

(19)

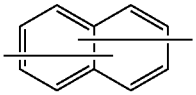

(20)

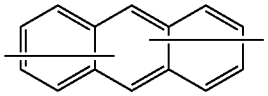

(21)

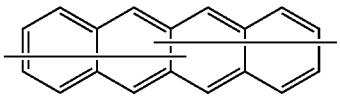

(22)

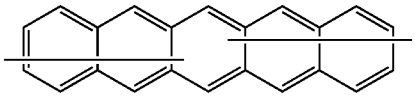

(23)

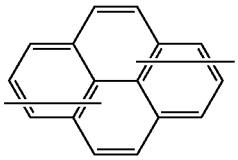

(24)

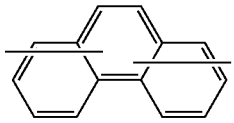

-continued (25)

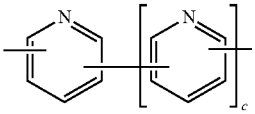

(26)

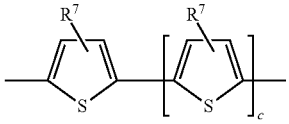

(27)

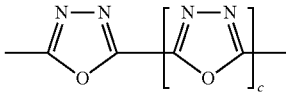

(28)

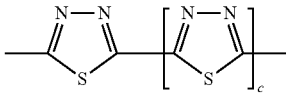

(29)

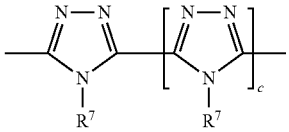

In the formula (9), b represents an integer of from 1 to 10, preferably represents an integer of from 1 to 6, and more preferably represents an integer of from 1 to 4.

In the formula (15), $R^6$'s each independently represent a hydrogen atom, an alkyl group or a cyano group.

In the formulae (26) and (29), $R^7$'s each independently represent a hydrogen atom, an alkyl group having from 1 to 10 carbon atoms, an alkoxy group having from 1 to 10 carbon atoms, a substituted or unsubstituted phenyl group, a substituted or unsubstituted aralkyl group, or a halogen atom.

In the formulae (15), (16) and (25) to (29), c's each independently represent an integer of from 0 to 10, preferably represent an integer of from 0 to 6, and more preferably represent an integer of from 1 to 3.

Plural $Y^1$'s that are present in the compound containing the structural unit represented by the formula (II-1) may be identical with or different from each other, but from the viewpoint of manufacturability, it is preferable that $Y^1$'s be identical.

In the formula (II-1), m represents an integer of from 1 to 5. From the viewpoint of a balance between solubility and the increase of the molecular weight, m is preferably an integer of from 1 to 3, and from the viewpoint of increasing the molecular weight, m is more preferably an integer of from to 2. Furthermore, from the viewpoint of making the electrical characteristics of the image holding member for an image forming apparatus satisfactory, m in the formula (II-1) is most preferably 1.

In the formula (II-1), $R^2$'s each independently represent a hydrogen atom, an alkyl group, a substituted or unsubstituted aryl group, or a substituted or unsubstituted aralkyl group.

Specific examples of the alkyl group, aryl group and aralkyl group, and of the substituents substituting those groups are the same as the specific examples described above as the substituents substituting the aromatic ring of Ar.

Furthermore, in the formula (II-1), $R^2$ may be a hydrogen atom or a phenyl group among those, and from the viewpoints of low cost and ease of preparation, $R^2$ is a hydrogen atom. Furthermore, two $R^2$'s in the formula (II-1) may be identical with or different from each other, but when $R^2$'s are identical, it is easier to prepare a charge transporting polyester.

Two $R^2$'s in the formula (II-1) may be identical with or different from each other, but from the viewpoint of manufacturability, it is preferable that $R^2$'s be identical.

In the formula (II-1), p represents an integer of from 5 to 5,000, but may also be in the range of from 10 to 1000.

More specifically, the weight average molecular weight Mw of the charge transporting polyester may be, for example, in the range of from 5,000 to 300,000, and may also be in the range of from 10,000 to 1,000,000.

The weight average molecular weight Mw is measured by the following method. That is, the weight average molecular weight is determined by preparing a 1.0% by weight tetrahydrofuran solution of a charge transporting polyester, and measuring the molecular weight by gel permeation chromatography (GPC) using a differential refractive index detector (RI), while using styrene polymers as standard samples.

Furthermore, the glass transition temperature (Tg) of the charge transporting polyester may be, for example, from 60° C. to 300° C., and may also be from 100° C. to 200° C.

Meanwhile, the glass transition temperature is measured by differential scanning calorimetry using $\alpha$-$Al_2O_3$ as a reference, by increasing the temperature of the sample until the sample reaches a rubbery state, quenching the sample by immersing the sample in liquid nitrogen, and then increasing the temperature again under the conditions of a rate of temperature increase of 10° C./min.

<Method for Preparing Compound Containing Structural Unit Represented by Formula (II-1) (Polyester)>

A compound containing the structural unit represented by the formula (II-1) (polyester) is synthesized by performing polymerization by a known method, using a compound represented by the formula (I) obtained as described above.

A specific example is a method of introducing a substituent that will be described below, to the end of $R^1$ in the formula (I), and specifically, the following synthesis methods may be used.

1) when $R^1$ is Hydroxyl Group

A compound represented by the formula (I) is mixed with, for example, an equivalent amount of a dihydric alcohol represented by the formula: $HO—(Y^1—O)_m—H$, and the mixture is polymerized by using an acid catalyst. Meanwhile, $Y^1$ represents a dihydric alcohol residue, and has the same meaning as $Y^1$ in the formula (II-1). m represents an integer of from 1 to 5, and has the same meaning as m in the formula (II-1).

As the acid catalyst described above, any acid catalyst used in common esterification reactions, such as sulfuric acid, toluenesulfuric acid or trifluoroacetic acid is used. The acid catalyst is used in an amount in the range of from 1/10,000 part by weight to 1/10 part by weight, and preferably in the range of from 1/1,000 part by weight to 1/50 part by weight, relative to 1 part by weight of the monomer (that is, the compound represented by the formula (I); hereinafter, the same).

In order to remove water that is produced during the polymerization, it is preferable to use a solvent which azeotropically boils with water. Examples of the solvent which azeotropically boils with water include toluene, chlorobenzene, and 1-chloronaphthalene, and the solvent is used in an amount in the range of from 1 part by weight to 100 parts by weight, and preferably in the range of from 2 parts by weight to 50 parts by weight, relative to 1 part by weight of the monomer.

The reaction temperature is set according to the conditions, but in order to remove water that is produced during the polymerization, it is preferable to carry out the reaction at the boiling point of the solvent.

After completion of the reaction, if a solvent has not been used in the reaction, the reaction product is dissolved in a solvent which dissolves the product. If a solvent has been used, the reaction solution is directly added dropwise to an alcohol such as methanol or ethanol, or to a poor solvent in which the polymer is not easily dissolved, such as acetone, and thereby the polyester is precipitated. The polyester is separated, and then is washed with water or an organic solvent and dried.

Furthermore, if necessary, a reprecipitation treatment of dissolving the polyester in an organic solvent, adding the solution dropwise to a poor solvent, and precipitating the polyester may be repeated. During the reprecipitation treatment, it is preferable to carry out the treatment while the system is efficiently stirred with a mechanical stirrer or the like. At the time of the reprecipitation treatment, the solvent for dissolving the polyester is used in an amount in the range of from 1 part by weight to 100 parts by weight, and preferably in the range of from 2 parts by weight to 50 parts by weight, relative to 1 part by weight of the polyester. The poor solvent is used in an amount in the range of from 1 part by weight to 1,000 parts by weight, and preferably in the range of from 10 parts by weight to 500 parts by weight, relative to 1 part by weight of the polyester.

2) when $R^1$ is Halogen

A compound represented by the formula (I) is mixed with, for example, an equivalent amount of a dihydric alcohol represented by the formula: $HO—(Y^1—O)_m—H$, and the mixture is polymerized by using an organic basic catalyst such as pyridine or triethylamine. Meanwhile, $Y^1$ represents a dihydric alcohol residue, and has the same meaning as $Y^1$ in the formula (II-1). m represents an integer of from 1 to 5, and has the same meaning as m in the formula (II-1).

The organic basic catalyst is used in an amount in the range of from 1 equivalent to 10 equivalents, and preferably in the range of from 2 equivalents to 5 equivalents, relative to 1 equivalent of the monomer (that is, the compound represented by the formula (I)).

Examples of the solvent include methylene chloride, tetrahydrofuran (THF), toluene, chlorobenzene, and 1-chloronaphthalene, and the solvent is used in an amount in the range of from 1 part by weight to 100 parts by weight, and preferably in the range of from 2 parts by weight to 50 parts by weight, relative to 1 part by weight of the monomer.

The reaction temperature is set according to the conditions. After the polymerization, a reprecipitation treatment is carried out as described above, and thus the polyester is purified.

Furthermore, when a dihydric alcohol having a high degree of acidity, such as bisphenol, is used, an interfacial polymerization method may also be used. That is, polymerization is carried out by adding a dihydric alcohol to water, adding an equivalent amount of a base to dissolve the base therein, and then adding the dihydric alcohol and an equivalent amount of the monomer solution while vigorously stirring the reaction system. At this time, water is used in an amount in the range of from 1 part by weight to 1,000 parts by weight, and preferably in the range of from 2 parts by weight to 500 parts by weight, relative to 1 part by weight of the dihydric alcohol. Examples of the solvent for dissolving the monomer include methylene chloride, dichloroethane, trichloroethane, toluene, chlorobenzene, and 1-chloronaphthalene.

The reaction temperature is set according to the conditions, and in order to accelerate the reaction, a phase transfer catalyst such as an ammonium salt or a sulfonium salt may also be used. The phase transfer catalyst is used in an amount in the range of from 0.1 part by weight to 10 parts by weight, and preferably in the range of from 0.2 part by weight to 5 parts by weight, relative to 1 part by weight of the monomer.

3) When $R^1$ is $—O—R^9$

Synthesis is carried out by adding an excess of a dihydric alcohol represented by the formula: $HO—(Y^1—O)_m—H$ to a compound represented by the formula (I), and performing a transesterification reaction by heating the mixture using an inorganic acid such as sulfuric acid or phosphoric acid, a titanium alkoxide, an acetate or carbonate of calcium or cobalt, or an oxide of zinc or lead as a catalyst. Here, $Y^1$ represents a dihydric alcohol residue, and has the same meaning as $Y^1$ in the formula (II-1). m represents an integer of from 1 to 5, and has the same meaning as m used in the formula (II-1).

The dihydric alcohol is used in an amount in the range of from 2 equivalents to 100 equivalents, and preferably in the range of from 3 equivalents to 50 equivalents, relative to 1 equivalent of the monomer (compound represented by the formula (I)).

The catalyst is used in an amount in the range of from 1/10,000 part by weight to 1 part by weight, and preferably in the range of from 1/1,000 part by weight to ½ part by weight, relative to 1 part by weight of the monomer.

The reaction is carried out at a reaction temperature of from 200° C. to 300° C., and after completion of the transesterification reaction from —O—$R^9$ to —O—$(Y^1—O)_m$—H, it is preferable to perform the reaction under reduced pressure in order to accelerate polymerization through elimination of HO—$(Y^1—O)_m$—H. Furthermore, the reaction may also be carried out by using a high boiling point solvent which azeotropically boils with HO—$(Y^1—O)_m$—H, such as 1-chloronaphthalene, and azeotropically eliminating HO— $(Y^1—O)_m$—H under normal pressure (under atmospheric pressure).

Furthermore, the polyester represented by the formula (II-1) may be synthesized as follows.

In the respective cases of 1) to 3), a compound represented by the following formula (VII) is prepared by adding an excess of a dihydric alcohol and carrying out the reaction. Subsequently, this compound is used instead of the monomer represented by the formula (I), and the compound is allowed to react with a divalent carboxylic acid, a divalent carboxylic acid halide or the like. Thereby, a polyester represented by the formula (II-1) is obtained.

Furthermore, $Y^1$, m, p and $R^2$ in the polymer compounds have the same meanings as $Y^1$, m, p and $R^2$ in the formula (II-1), respectively.

| Polymer Compound No. | Structure No. of $A^1$ | $Y^1$ | m | $R^2$ | p |
|---|---|---|---|---|---|
| 1 | 1 | $—(CH_2)_2—$ | 1 | H | 38 |
| 2 | 1 | $—(CH_2)_6—$ | 1 | H | 36 |
| 3 | 2 | 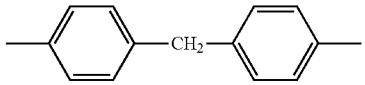 | 1 | H | 48 |
| 4 | 3 | $—(CH_2)_2—$ | 1 | H | 56 |
| 5 | 4 | $—(CH_2)_2—$ | 1 | H | 47 |
| 6 | 4 | 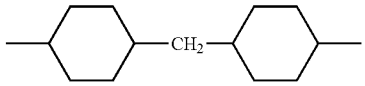 | 1 | H | 37 |
| 7 | 8 | $—(CH_2)_2—$ | 1 | H | 48 |

(VII)

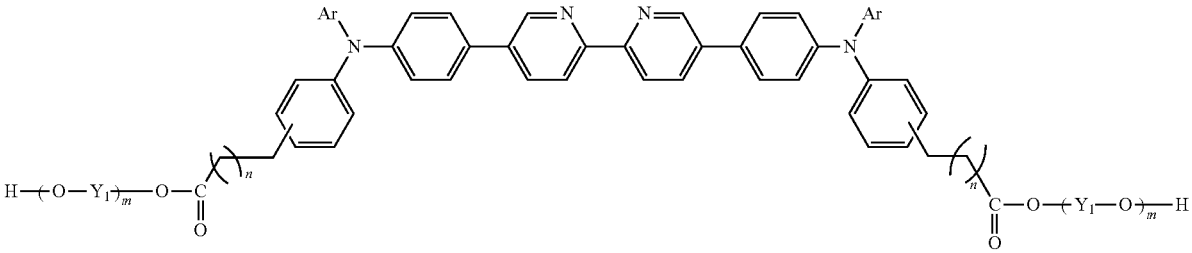

In the formula (VII), Ar and n have the same meanings as Ar and n in the formula (I), respectively, and $Y^1$ and m have the same meanings as $Y^1$ and m in the formula (II-1), respectively.

Meanwhile, among the synthesis methods of 1) to 3), preparation is easily achieved by following the synthesis method of 1) in the exemplary embodiment.

As specific examples of the polyester represented by the formula (II-1), polymer compounds 1 to 34 (that is, specific example polyesters 1 to 34) are shown below, but the exemplary embodiment is not limited to these specific examples.

Meanwhile, the number in the column of monomer (column of "Structural No. of $A^1$") in the polymer compound corresponds to the Monomer Compound No. of the compound represented by the formula (I). In the following, specific examples (compounds) each assigned with a number, for example, the structure of $A^1$ assigned with the number 15 means a structure derived from the monomer compound 15.

-continued

| Polymer Compound No. | Structure No. of $A^1$ | $Y^1$ | m | $R^2$ | p |
|---|---|---|---|---|---|
| 8 | 8 | 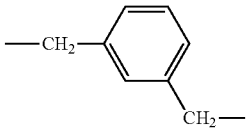 | 1 | H | 42 |
| 9 | 9 | $—(CH_2)_2—$ | 1 | H | 34 |
| 10 | 11 | $—(CH_2)_2—$ | 1 | H | 58 |

-continued

| Polymer Compound No. | Structure No. of $A^1$ | $Y^1$ | m | $R^2$ | p |
|---|---|---|---|---|---|
| 11 | 11 | 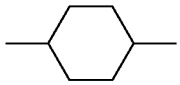 | 1 | H | 68 |
| 12 | 11 | 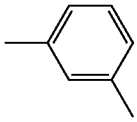 | 1 | H | 71 |
| 13 | 12 | $-(CH_2)_2-$ | 1 | H | 72 |
| 14 | 13 | $-(CH_2)_2-$ | 1 | H | 46 |
| 15 | 14 | $-(CH_2)_2-$ | 1 | H | 62 |
| 16 | 14 | 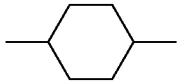 | 1 | H | 48 |
| 17 | 15 | $-(CH_2)_2-$ | 1 | H | 45 |
| 18 | 16 | $-(CH_2)_2-$ | 1 | H | 48 |
| 19 | 17 | $-(CH_2)_2-$ | 1 | H | 63 |
| 20 | 18 | 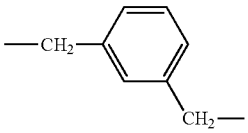 | 1 | H | 53 |
| 21 | 19 | $-(CH_2)_2-$ | 1 | H | 63 |
| 22 | 19 | $-(CH_2)_2-$ | 1 | H | 51 |
| 23 | 20 | $-(CH_2)_2-$ | 1 | H | 53 |
| 24 | 21 | $-(CH_2)_2-$ | 1 | H | 59 |
| 25 | 22 | $-(CH_2)_2-$ | 1 | H | 78 |
| 26 | 23 | $-(CH_2)_2-$ | 1 | H | 62 |
| 27 | 24 | $-(CH_2)_2-$ | 1 | H | 42 |
| 28 | 25 | $-(CH_2)_6-$ | 1 | H | 48 |
| 29 | 26 | $-(CH_2)_2-$ | 1 | H | 65 |
| 30 | 27 | $-(CH_2)_2-$ | 1 | H | 65 |
| 31 | 28 | $-(CH_2)_2-$ | 1 | H | 65 |

-continued

| Polymer Compound No. | Structure No. of $A^1$ | $Y^1$ | m | $R^2$ | p |
|---|---|---|---|---|---|
| 32 | 29 | $-(CH_2)_2-$ | 1 | H | 65 |
| 33 | 31 | $-(CH_2)_2-$ | 1 | H | 65 |
| 34 | 32 | $-(CH_2)_2-$ | 1 | H | 65 |

In the image holding member for an image forming apparatus of the exemplary embodiment, as described above, at least one of the compound represented by the formula (I) and the compound represented by the formula (II-1) is included in the photosensitive layer. It can be contemplated that when at least one of the compound represented by the formula (I) and the compound represented by the formula (II-1) has high charge transportability, the charge injectability (particularly, injectability of positive charge) from the charge generating layer is improved. It is thought that, as a result, for example, the charge-up phenomenon and the like do not easily occur, the variance of the residual potential due to repeated use is decreased, and thus excellent environmental sustainability is exhibited.

Furthermore, in the image holding member for an image forming apparatus of the exemplary embodiment, since at least one of the compound represented by the formula (I) and the compound represented by the formula (II-1) has excellent compatibility with resins, the thickness irregularity of the photosensitive layer is decreased. It is thought that, as a result, the variance of the residual potential due to a repeated use of the image holding member is decreased.

Furthermore, in the image forming apparatus and process cartridge of the exemplary embodiment, since the image holding member for an image forming apparatus of the exemplary embodiment is used, satisfactory image quality may be obtained for a long time, which leads to a reduction in the environmental burden and a large cost reduction.

<Configuration of Image Holding Member for Image Forming Apparatus>

Hereinafter, the configuration of the image holding member for an image forming apparatus of the exemplary embodiment will be described.

The image holding member for an image forming apparatus of the exemplary embodiment is an image holding member for an image forming apparatus having a photosensitive layer on a support, and is characterized in that the photosensitive layer contains at least one of the compound represented by the formula (I) and the compound represented by the formula (II-1).

Figure 2:
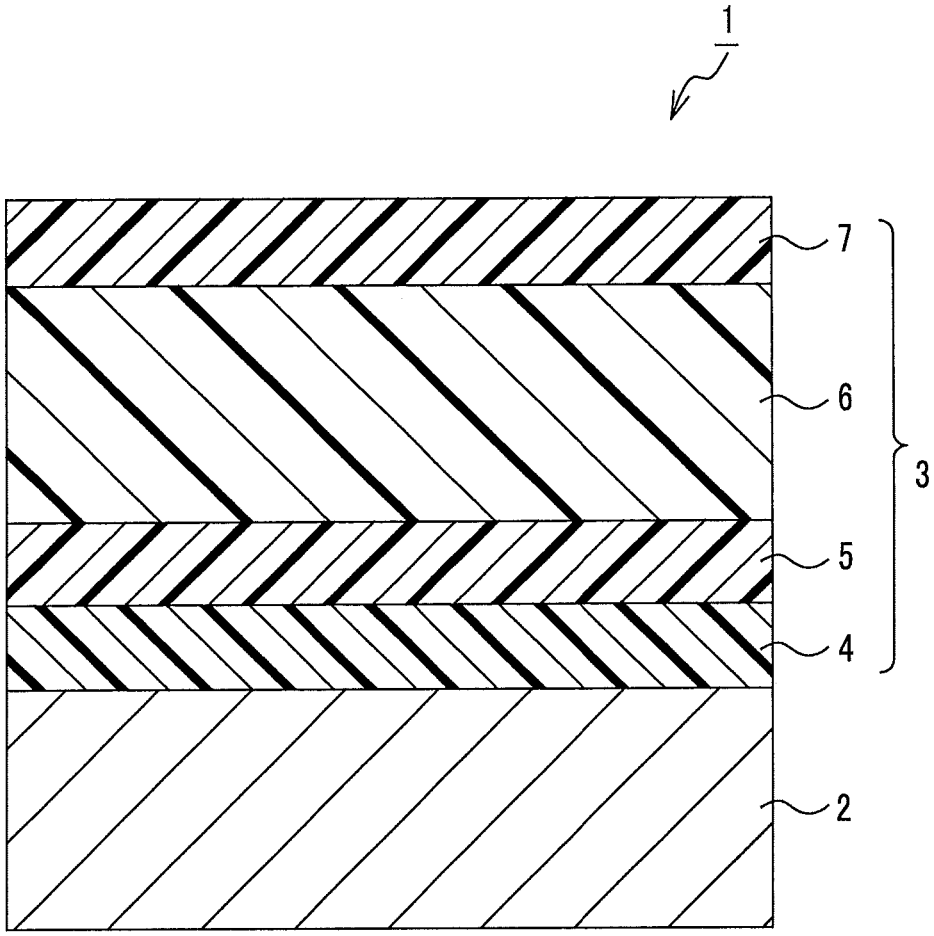
FIG. 2 is a schematic cross-sectional view of the image holding member for an image forming apparatus related to a second exemplary embodiment.
Figure 3:
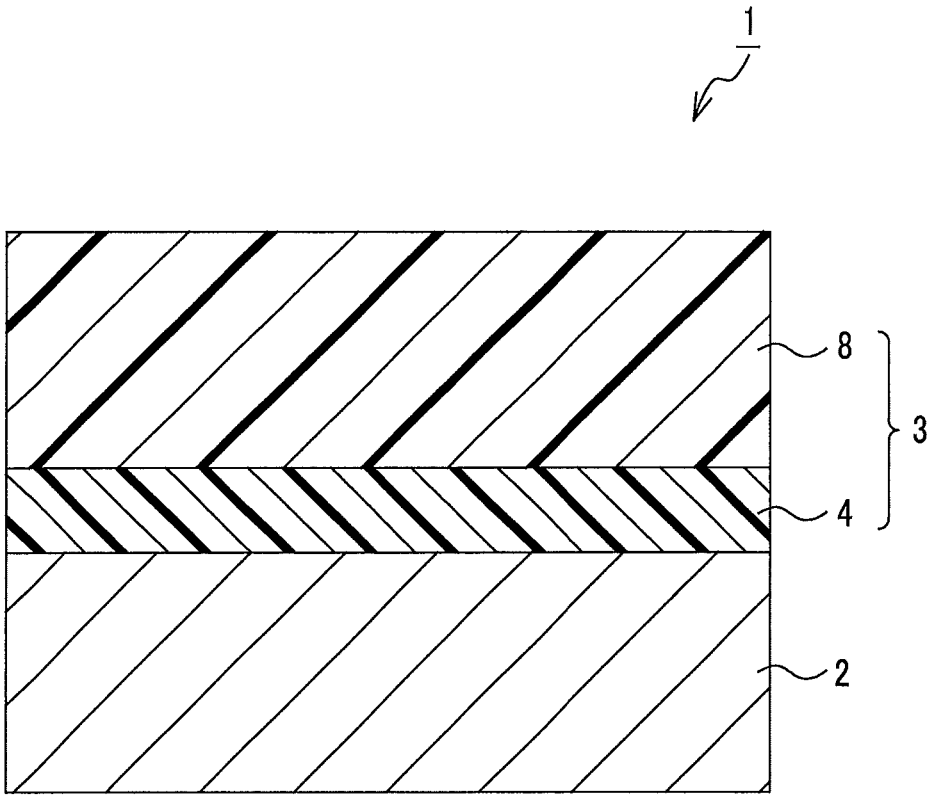
FIG. 3 is a schematic cross-sectional view of the image holding member for an image forming apparatus related to a third exemplary embodiment.

FIG. 1 to FIG. 3 are schematic cross-sectional diagrams showing the first exemplary embodiment to the third exemplary embodiment of the image holding member for an image forming apparatus of the exemplary embodiment of the present invention.

These diagrams all show the cross-sections prepared by cutting the image holding member 1 for an image forming apparatus along the lamination direction of the conductive support 2 and the photosensitive layer 3.

The image holding members 1 for image forming apparatuses according to the first and second exemplary embodiments as shown in FIG. 1 and FIG. 2 include a functionally separated photosensitive layer in which a charge generating material and a charge transporting material are included in different layers. That is, in the photosensitive layer 3, a layer containing a charge generating material (charge generating layer 5) and a layer containing a charge transporting material (charge transport layer 6) are separately formed, and the layers are laminated to be adjacent to each other.

On the other hand, the image holding member 1 for an image forming apparatus according to the third exemplary embodiment as shown in FIG. 3 includes a single-layer type photosensitive layer in which a charge generating material and a charge transporting material are included in the same layer. That is, in the photosensitive layer 3, a charge generating/transport layer 8 containing a charge generating material and a charge transporting material is formed as a single layer.

More particularly, in the image holding member 1 for an image forming apparatus according to the first exemplary embodiment, an undercoat layer 4, a charge generating layer 5 and a charge transport layer 6 are laminated in this order on a conductive support 2, and thereby a photosensitive layer 3 is constructed. In the image holding member 1 for an image forming apparatus according to the second exemplary embodiment, an undercoat layer 4, a charge generating layer 5, a charge transport layer 6 and a protective layer 7 are laminated in this order on a conductive support 2, and thereby a photosensitive layer 3 is constructed. Furthermore, in the image holding member 1 for an image forming apparatus according to the third exemplary embodiment, an undercoat layer 4 and a charge generating/transport layer 8 are laminated in this order on a conductive support 2, and thereby a photosensitive layer 3 is constructed.

Although not depicted in the diagrams, as a modification of the second exemplary embodiment, an embodiment in which the lamination sequence of the charge generating layer 5 and the charge transport layer 6 of the second exemplary embodiment is inverted, or as a modification of the third exemplary embodiment, an embodiment in which the protective layer 7 used in the second exemplary embodiment is formed on the charge generating/transport layer 8 of the third exemplary embodiment, may also be used.

As the conductive support 2, a support prepared by forming aluminum into a drum shape, a sheet shape, a plate shape or the like may be used, but the conductive support is not intended to be limited to these. The conductive support 2 may be subjected to an anodization treatment, a boehmite treatment, a honing treatment or the like.

In the region interposed between the conductive support 2 and the photosensitive layer 3 or the region interposed between the conductive support 2 and the charge generating/transport layer 8, as shown in FIG. 1 to FIG. 3, the undercoat layer 4 is provided. The undercoat layer 4 is formed by using an organozirconium compound such as a zirconium chelate compound, a zirconium alkoxide compound, or a zirconium coupling agent; an organotitanium compound such as a titanium chelate compound, a titanium alkoxide compound or a titanate coupling agent; an organoaluminum compound such as an aluminum chelate compound, or an aluminum coupling agent; or an organometallic compound such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, or an aluminum zirconium alkoxide compound. Particularly, an organozirconium compound, an organotitanium compound or an organoaluminum compound is preferably used.

Furthermore, a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3,4-epoxycyclohexyltrimethoxysilane is further incorporated.

Furthermore, a known binder resin such as a polyvinyl alcohol, a polyvinyl methyl ether, a poly-N-vinylimidazole, a polyethylene oxide, an ethyl cellulose, a methyl cellulose, an ethylene-acrylic acid copolymer, a polyamide, a polyimide, casein, gelatin, a polyethylene, a polyester, a phenolic resin, a vinyl chloride-vinyl acetate copolymer, an epoxy resin, a polyvinylpyrrolidone, a polyvinylpyridine, a polyurethane, a polyglutamic acid, or a polyacrylic acid may be further incorporated. The mixing proportions of these agents may be set according to necessity.

Furthermore, in the undercoat layer 4, an electron transporting pigment may be used by mixing or dispersing the pigment in the layer.

Examples of the electron transporting pigment include organic pigments such as perylene pigments, bisbenzimidazole perylene pigments, polycyclic quinone pigments, indigo pigments, and quinacridone pigments described in JP-A-47-30330. Furthermore, organic pigments such as bisazo pigments having electron-withdrawing substituents such as a cyano group, a nitro group, a nitroso group or a halogen atom, and phthalocyanine pigments; and inorganic pigments such as zinc oxide and titanium oxide may be used. Among these pigments, a perylene pigment, a bisbenzimidazole perylene pigment, a polycyclic quinone pigment, zinc oxide or titanium oxide is preferable.

Furthermore, the surfaces of these pigments may be surface treated with the coupling agents described above, or with binders. The content of the electron transporting pigment used in the undercoat layer 4 is 95% by weight or less, and preferably 90% by weight or less, relative to the total weight of the undercoat layer 4.

As the method for mixing or dispersing an electron transporting pigment in the undercoat layer 4, routine methods of using a ball mill, a roll mill, a sand mill or an attritor, or using ultrasonic waves are applied. The process of mixing and dispersing is carried out in an organic solvent, and as the organic solvent, any solvent which is capable of dissolving an organometallic compound or a resin, and does not cause gelation or aggregation when an electron transporting pigment is mixed or dispersed therein, may be used.

The thickness of the undercoat layer 4 is preferably from 0.1 μm to 30 μm, and more preferably from 0.2 μm to 25 μm.

Furthermore, as the coating method used to provide the undercoat layer 4, a common method such as a blade coating method, a Meyer bar coating method, a spray coating method, a dip coating method, a bead coating method, an air knife coating method, or a curtain coating method is used.

A coating film formed by applying a composition for undercoat layer formation containing the above-described components is dried to thereby obtain an undercoat layer 4, and usually, the drying process is carried out at a temperature at which a film may be formed by evaporating the solvent. Particularly, since a base material that has been subjected to an acidic solution treatment or a boehmite treatment is likely to have an insufficient defect covering power of the base material, it is preferable to form the undercoat layer 4.

As the charge generating material incorporated in the charge generating layer 5, well known materials such as azo pigments such as bisazo and trisazo compounds; condensed ring aromatic pigments such as dibromoanthanthrone; perylene pigments, pyrrolopyrrole pigments, and phthalocyanine pigments may be used, but particularly, metallic and metal-free phthalocyanine pigments are preferable. Among them, hydroxygallium phthalocyanine disclosed in JP-A-5-263007 and JP-A-5-279591; chlorogallium phthalocyanine disclosed in JP-A-5-98181; dichlorotin phthalocyanine disclosed in JP-A-5-140472 and JP-A-5-140473; or titanyl phthalocyanine disclosed in JP-A-4-189873 and JP-A-5-43813 is particularly preferable.

The charge generating layer 5 is formed by mixing a charge generating material and a binder resin, and such a binder resin is selected from a wide variety of insulating resins, and may also be selected from organic photoconductive polymers such as poly-N-vinylcarbazole, polyvinylanthracene, polyvinylpyrene, and polysilanes. Preferable examples of the binder resin include, but are not limited to, insulating resins such as a polyvinyl butyral resin, a polyallylate resin (a polycondensate of bisphenol A and phthalic acid, or the like), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. These binder resins are used individually or as mixtures of two or more kinds thereof.

Furthermore, the insulating resin as used in the exemplary embodiment refers to an insulating resin having a volume resistivity of $10^{12}$ Ω·cm or higher as measured based on JIS K 7194 "Testing method for resistivity of conductive plastics with a four-point probe array".

The mixing ratio (weight ratio) of the charge generating material and the binder resin is preferably in the range of 10:1 to 1:10, and more preferably 8:3 to 3:8.

Furthermore, as a method of dispersing these components, a common method such as a ball mill dispersion method, an attritor dispersion method, or a sand mill dispersion method is used, but at this time, conditions under which the crystal form of the charge generating material does not change as a result of dispersing are required. Meanwhile, it is confirmed that the above-described dispersing methods used in the exemplary embodiment are not changed in the crystal form as compared with the crystal form before the dispersing process.

Furthermore, during this dispersion, it is effective to adjust the particles of the charge generating material to a particle size of 0.5 μm or less, preferably 0.3 μm or less, and more preferably 0.15 μm or less.

The thickness of the charge generating layer 5 is preferably from 0.1 μm to 5 μm, and more preferably from 0.2 μm to 2.0 μm. Furthermore, as the coating method used to provide the charge generating layer 5, a common method such as a blade coating method, a Meyer bar coating method, a spray coating method, a dip coating method, a bead coating method, an air knife coating method, or a curtain coating method is used.

As the charge transport layer 6, any layer formed by a known technology may be used, except for incorporating at least one of the compound represented by the formula (I) and the compound represented by the formula (II-1).

The charge transport layer 6 is such that as long as at least one of the compound represented by the formula (I) and the compound represented by the formula (II-1) is incorporated, the charge transport layer 6 may be formed to additionally contain a charge transporting material, a binder resin or the like. Meanwhile, in the case where the compound represented by the formula (I) is used so that the compound represented by the formula (II-1) is not used, it is preferable to use the compound represented by the formula (I) by dispersing the compound in a binder resin or the like. Furthermore, in the case of using the compound represented by the formula (II-1), the charge transport layer 6 is formed even without using other resins; however, from the viewpoint of cost reduction, it is preferable to use the compound represented by the formula (II-1) in a mixture with other resins.

Examples of other charge transporting materials include other charge transporting materials, including electron transporting compounds, such as quinone-based compounds such as p-benzoquinone, chloranil, bromanil, and anthraquinone, tetracyanoquinodimethane-based compounds, fluorenone compounds such as 2,4,7-trinitrofluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl-substituted ethylene-based compounds, stilbene-based compounds, anthracene-based compounds, and hydrazone-based compounds. However, the charge transporting materials are not limited to these.

The content of the compound represented by the formula (I) and the compound represented by the formula (II-1) in the total amount of the charge transport layer 6 is preferably from 5% by weight to 70% by weight, more preferably from 10% by weight to 60% by weight, and even more preferably from 20% by weight to 50% by weight.

When the compound represented by the formula (I) and the compound represented by the formula (II-1) are used in combination as the charge transporting material, the content of the compound represented by the formula (I) and the compound represented by the formula (II-1) in the total amount of the charge transporting material is preferably 1% by weight or more, and more preferably 5% by weight or more.

In the case of using a binder resin in the charge transporting layer 6, examples of the binder resin include polymeric charge transporting materials such as a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, polysilane, and the polyester-based polymeric charge transporting material disclosed in JP-A-8-176293 or JP-A-8-208820. These binder resins are used individually or as mixtures of two or more kinds thereof. The mixing ratio of (weight ratio) of the charge transporting material and the binder resin is preferably 10:1 to 1:10, and more preferably 8:3 to 3:8.

The thickness of the charge transport layer 6 is preferably from 5 μm to 50 μm, and more preferably from 10 μm to 30 μm.

As the coating method, a common method such as a blade coating method, a wire bar coating method, a spray coating method, a dip coating method, a bead coating method, an air knife coating method, or a curtain coating method is used.

Furthermore, additives such as an antioxidant, a light stabilizer and a thermal stabilizer may be added to the photosensitive layer.

Also, the photosensitive layer may contain at least one electron accepting material.

The image holding member for an image forming apparatus of the exemplary embodiment may include a protective layer 7 (surface layer), and it is preferable to make the protective layer 7 as a high-strength protective layer (high-strength surface layer). As this high-strength protective layer, a layer in which conductive particles are dispersed in a binder resin, a layer in which lubricating particles of a fluororesin, an acrylic resin or the like are dispersed in a common charge transport layer material, or a hard coating agent formed from a silicone or an acrylic resin, is used. The high-strength protective layer preferably contains a siloxane-based resin which has charge transporting properties and has a crosslinked structure.

In the protective layer 7, other coupling agents and fluorine compounds may be incorporated. Various silane coupling agents and commercially available silicone-based hard coating agents are used as these compounds.

The coating liquid used in the formation of the protective layer 7 may be prepared without solvent, or may be prepared using a solvent as necessary.

The reaction temperature and time may vary with the type of the raw material, but usually, the reaction is carried out at a temperature of from 0° C. to 100° C., preferably from 10° C. to 70° C., and particularly preferably from 15° C. to 50° C. The reaction time is not particularly limited, but the reaction time is preferably in the range of from 10 minutes to 100 hours.

Examples of a curing catalyst include a protic acid such as hydrochloric acid, acetic acid, phosphoric acid or sulfuric acid; a base such as ammonia or triethylamine; an organotin compound such as dibutyltin diacetate, dibutyltin dioctoate, or stannous octoate; an organotitanium compound such as tetra-n-butyl titanate or tetraisopropyl titanate; an organoaluminum compound such as aluminum tributoxide or aluminum triacetylacetonate; an iron salt, a manganese salt, a cobalt salt, a zinc salt or a zirconium salt of an organic carboxylic acid. However, a metal compound is preferable, and a metal acetylacetonate or a metal acetylacetate is more preferable, while aluminum triacetylacetonate is particularly preferable.

The amount of the curing catalyst used is set according to necessity, but the amount is preferably from 0.1% by weight to 20% by weight, and more preferably from 0.3% by weight to 10% by weight, relative to the total amount of the material containing a hydrolyzable silicon substituent.

The curing temperature is set according to necessity, but in order to obtain a desired strength, the curing temperature is set to a temperature of 60° C. or higher, and more preferably 80° C. or higher. The curing time is set according to necessity, but the curing time is preferably from 10 minutes to 5 hours.

Furthermore, after the curing reaction is carried out, it is also effective to maintain the protective layer in a high humidity state. Also, depending on the use, the protective layer is hydrophobized by performing a surface treatment using hexamethyldisilazane, trimethylchlorosilane or the like.

In the protective layer 7 of the image holding member for an image forming apparatus, it is preferable to add an antioxidant.

Furthermore, in the protective layer 7 of the image holding member for an image forming apparatus, a resin which dissolves in alcohol may also be added.

Also, various particles may also be added to the protective layer 7. The particles may be used individually, but may also be used in combination. Examples of the particles include silicon-containing particles, fluorine-based particles and semiconductive metal oxide particles.

To the protective layer 7, an oil such as a silicone oil may be also added.

In the case of a single-layer type photosensitive layer, the single-layer type photosensitive layer may be formed to contain the charge generating material described above, the charge transporting material described above (including at least one of the compound represented by the formula (I) and the compound represented by the formula (II-1) of the exemplary embodiment), and a binder resin. Meanwhile, the charge transporting material may include a polymeric charge transporting material. As the binder resin, those listed as the binder resin used in the charge generating layer 5 and the charge transport layer 6 are used. The content of the charge generating material in the single-layer type photosensitive layer is from 10% by weight to 85% by weight, and preferably from 20% by weight to 50% by weight. Also, the content of the charge transporting material in the single-layer type photosensitive layer is preferably from 5% by weight to 50% by weight.

As the solvent or coating method used in the coating of the layer, the solvents and coating methods described above are used. The thickness of the single-layer photosensitive layer is preferably from 5 μm to 50 μm, and more preferably from 10 μm to 40 μm.

(Image Forming Apparatus)

The image forming apparatus of the exemplary embodiment of the present invention is characterized by including the image holding member for an image forming apparatus of the exemplary embodiment described above; a charging unit that charges the image holding member for an image forming apparatus; an exposure unit that exposes the charged image holding member for an image forming apparatus to form an electrostatic latent image; a developing unit that develops the electrostatic latent image to form a toner image; and a transfer unit that transfers the toner image to a transfer medium.

Figure 4:
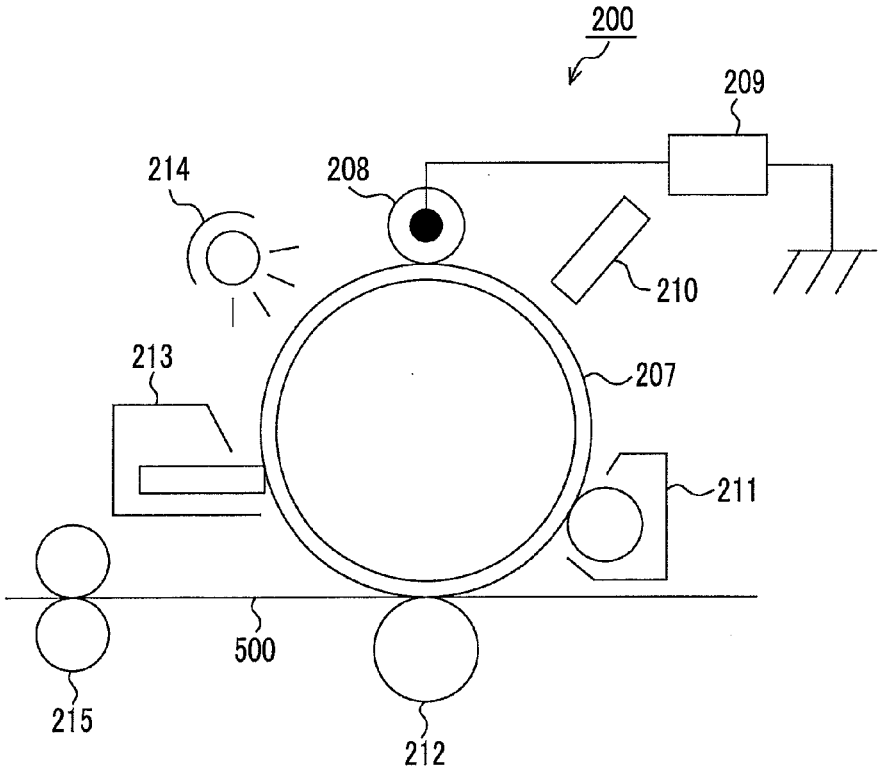
FIG. 4 is a schematic configuration diagram of an image forming apparatus related to exemplary embodiments.

FIG. 4 is a cross-sectional diagram schematically showing the basic configuration of a suitable exemplary embodiment of the image forming apparatus of the exemplary embodiment of the present invention.

The image forming apparatus 200 shown in FIG. 4 includes the image holding member 207 for an image forming apparatus of the exemplary embodiment of the present invention; a charging unit 208 that charges the image holding member 207 for an image forming apparatus by a contact charging mode; a power supply 209 that is connected to the charging unit 208; an exposure unit 210 that exposes the image holding member 207 for an image forming apparatus charged by the charging unit 208 to form an electrostatic latent image; a developing unit 211 that develops the electrostatic latent image formed by the exposure unit 210 with a toner to forma toner image; a transfer unit 212 that transfers the toner image formed by the developing unit 211 to a transfer medium 500; a cleaning unit 213; an erasing device 214; and a fixing unit 215.

The charging unit 208 shown in FIG. 4 brings a contact type charging member (for example, a charging roller) into contact with the surface of the image holding member 207 for an image forming apparatus, and charges the surface of the image holding member by applying a voltage to the image holding member.

As the contact type charging member, a roller-shaped member provided with an elastic layer, a resistive layer, a protective layer and the like on the outer peripheral surface of a core material, is suitably used. The shape of the contact type charging member may be any of a brush shape, a blade shape or a pin electrode shape, in addition to the roller shape described above, and the shape is selected in accordance with the specifications or form of the image forming apparatus.

As the material of the core material for the roller-shaped contact type charging member, a material having electrical conductivity, for example, iron, copper, brass, stainless steel, aluminum, or nickel is used. Furthermore, a resin-molded article containing dispersed conductive particles, or the like is used. As the material of the elastic layer, a material having electrical conductivity or semiconductivity, for example, a rubber material having conductive particles or semiconductive particles dispersed therein is used. As the material of the resistive layer and the protective layer, a binder resin having its resistance controlled by dispersing conductive particles or semiconductive particles therein, is used.

When the image holding member is charged by using such a contact type charging member, a voltage is applied to the contact type charging member, but the voltage applied as such may be any of a direct current voltage, and an alternating current voltage superimposed on a direct current voltage.

Meanwhile, a corona charging unit of a non-contact system, such as a corotron or a scorotron, may also be used instead of the contact type charging member shown in FIG. 4. This is selected in accordance with the specifications or form of the image forming apparatus.

As the exposure unit 210, an optical device which exposes the surface of the image holding member for an image forming apparatus imagewise as desired to a light source such as a semiconductor laser, a light emitting diode (LED), or a liquid crystal shutter, may be used.

As the developing unit 211, an known developing unit in the related art using a regular or reversal developer of a single-component system or a two-component system, may be used. The shape of the toner particles used in the developing unit 211 is not particularly limited, but spherical toner particles are preferable.

As the transfer unit 212, a contact type transfer charger using a belt, a film, a rubber blade or the like, or a scorotron transfer charger or corotron transfer charger using corona discharge may be used, in addition to the roller-shaped contact type charging member.

The cleaning unit 213 is intended to remove any residual toner adhering to the surface of the image holding member for an image forming apparatus after the transfer step, and the image holding member for an image forming apparatus having its surface cleaned thereby may be repeatedly supplied to the image forming process. As the cleaning unit, brush cleaning, roll cleaning or the like is used, in addition to the cleaning blade; however, among these, it is preferable to use a cleaning blade. Furthermore, examples of the material of the cleaning blade include a urethane rubber, a neoprene rubber, and a silicone rubber.

The exemplary embodiment described above has one image forming unit, but an image forming apparatus according to another exemplary embodiment is a tandem type image forming apparatus having plural image forming units.

For example, when there are four image forming units, in the respective developing units of the four image forming units, for example, color component toners of four colors such as yellow, magenta, cyan and black are used. Also, it is preferable that a tandem type image forming apparatus include, commonly in the four image forming units, a belt that conveys a recording material, a conveying unit that conveys this belt, a toner supply unit that supplies a toner image to the respective developing units, and a fixing unit that fixes a color toner image to a recording material.

Furthermore, when the image holding member is used repeatedly for 200,000 cycles or more, or for 250,000 cycles or more, or even for 300,000 cycles or more, it is preferable that the image forming apparatus of the exemplary embodiment have a mechanism which replenishes only the toners.

(Process Cartridge)

The process cartridge of the exemplary embodiment is characterized by having at least the image holding member for an image forming apparatus of the exemplary embodiment described above, and including at least one selected from a charging unit that charges the image holding member for an image forming apparatus, an exposure unit that exposes the charged image holding member for an image forming apparatus to form an electrostatic latent image, a developing unit that develops the electrostatic latent image to form a toner image, a transfer unit that transfers the toner image to a transfer medium, and a cleaning unit that cleans the image holding member for an image forming apparatus.

Figure 5:
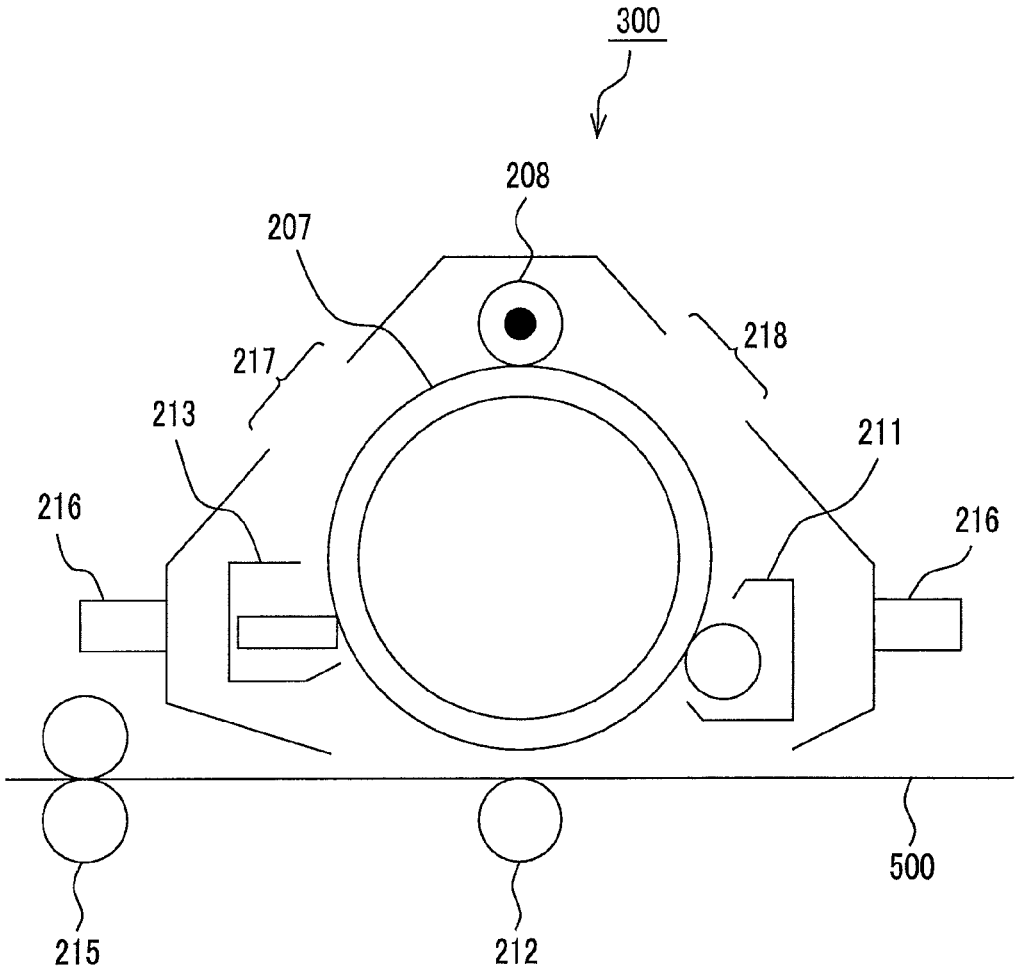
FIG. 5 is a schematic configuration diagram of a process cartridge related to exemplary embodiments.

FIG. 5 is a cross-sectional diagram schematically showing the basic configuration of a suitable exemplary embodiment of a process cartridge that includes the image holding member for an image forming apparatus of the exemplary embodiment.

The process cartridge 300 is a cartridge in which the image holding member 207 for an image forming apparatus is combined and integrated with a charging unit 208, a developing unit 211, a cleaning unit 213, an aperture 218 for exposure, and an aperture 217 for erasing exposure, using a mounting rail 216.

Also, this process cartridge 300 is a member configured to be detachable from the main body of the image forming apparatus which is composed of a transfer unit 212 that transfers the toner image formed by the developing unit 211 to a transfer medium 500, a fixing unit 215, and other constituent parts that are not shown in the diagram, and the process cartridge constitutes an image forming apparatus together with the main body of the image forming apparatus.

Thus, the exemplary embodiment of the present invention has been explained, but the exemplary embodiment may include various alterations or modifications within the scope of the gist of the invention.

EXAMPLES

Hereinafter, the present invention will be described based on Examples, but the invention is not intended to be limited to these.

Furthermore, in the Examples of the present invention, $^1$H-NMR spectroscopy (solvent: $CDCl_3$, manufactured by Varian, Inc., UNITY-300, 300 MHz) and infrared (IR) spectroscopy (Fourier transform infrared spectrophotometer using the KBr method, manufactured by Horiba, Ltd., FT-730, resolution power 4 $cm^{-1}$) are used for the identification of the target substance.

Furthermore, in the Examples, the molecular weight of a polymer is measured by gel permeation chromatography (GPC) (manufactured by Tosoh Corp., HLC-8120GPC).

[Synthesis of Compound Represented by Formula (I) or (II-1)]

Synthesis Example 1

Synthesis of Monomer Compound (14)

In a nitrogen atmosphere, 1.6 M n-butyllithium (78.0 ml) is dissolved in anhydrous tetrahydrofuran (100 ml), and a solution of 5-bromo-2-chloropyridine (20.0 g) dissolved in anhydrous THF (80 ml) is added dropwise thereto. The mixture is stirred for 3.5 hours at −78° C. 1.6 M n-butyllithium (19.6 ml) is added to the mixture, and the mixture is stirred for 1 hour at −78° C. Tri-n-butyl borate (28.8 g) is introduced to the mixture, and the obtained mixture is stirred for 2 hours at −78° C. and then is stirred overnight at room temperature (25° C.)

After completion of the reaction, the reaction solution is transferred to a separatory funnel and divided into an organic layer and an aqueous layer. An appropriate amount of sodium hydroxide (10%) is introduced into the aqueous layer to adjust the pH of the aqueous layer to 8. The aqueous layer is extracted three times with diethyl ether. 2,2-Dimethyl-1,3-propanediol (10.4 g, 104.0 mmol) and sodium sulfate are added to the organic layer to dry the organic layer. The organic layer is suction filtered, and the filtrate is distilled off under reduced pressure to obtain a crude product. This crude product is purified by column chromatography (hexane/ethyl acetate=1/1), and thus 2-chloro-5-(5,5-dimethyl-1,3,2-dioxaborinan-2-yl)pyridine (13.2 g) is obtained.

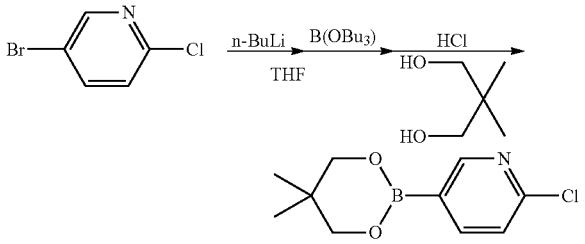

A liquid mixture of 1-bromo-4-iodobenzene (18.6 g), DAA-1 (17.5 g), copper(II) sulfate pentahydrate (1.0 g), potassium carbonate (4.6 g), and tridecane (10 ml) is stirred for 7 hours at 210° C.

After completion of the reaction, potassium hydroxide (15.6 g) dissolved in ethylene glycol (300 ml) is added to the reaction liquid, and the mixture is heated to reflux for 3.5 hours under a nitrogen gas stream and then cooled to room temperature (25° C.). The reaction liquid is poured into 1 L of distilled water, and is neutralized with hydrochloric acid, and crystals are precipitated. The crystals are collected by suction filtration, washed with water, and then transferred to a 1-L flask. Toluene (500 ml) is added to the crystals, and the mixture is heated to reflux. Water is removed by azeotropically boiling the mixture, and then a methanol (300 ml) solution of concentrated sulfuric acid (1.5 ml) is added to the resultant. The mixture is heated to reflux for 5 hours under a nitrogen gas stream.

The mixture is cooled to room temperature (25° C.), toluene is added thereto, and the mixture is filtered through Celite. The filter cake is washed with pure water, and the organic layer is extracted. The organic solvent is distilled off, and a product thus obtained is separated by silica gel column chromatography (hexane 4:toluene 1). Thus, TAA-1 (15.7 g) is obtained.

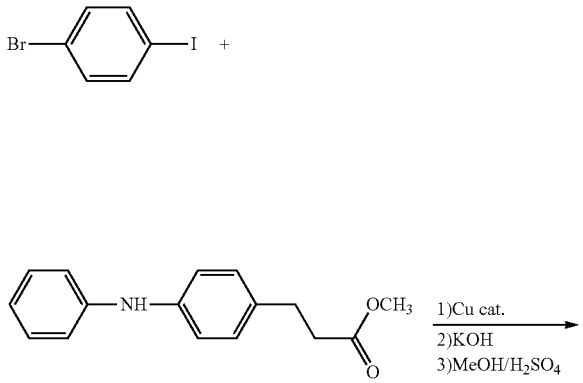

DAA-1

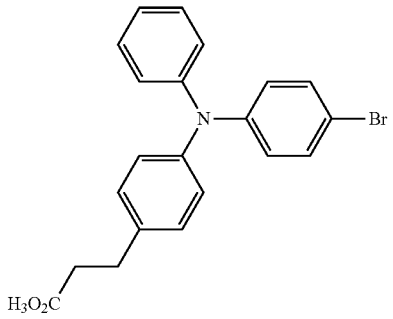

TAA-1

In a nitrogen atmosphere, TAA-1 (13.8 g), tetrakis(triphenylphosphine)palladium(0) (1.1 g), ethanol (30 ml), 2 M sodium carbonate (30 ml), and 2-chloro-5-(5,5-dimethyl-1,3,2-dioxaborinan-2-yl)pyridine (11.4 g) are dissolved in toluene, and the solution is refluxed and stirred for 6 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and a crude product is obtained. This crude product is purified by column chromatography (hexane/ethyl acetate=5/1), and thus TAA-2 (4.1 g) is obtained.

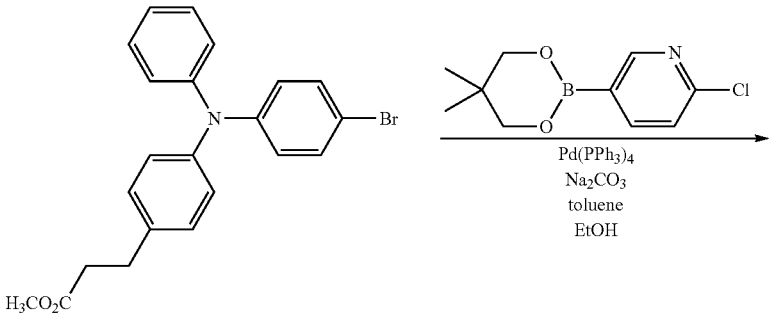

TAA-1

-continued

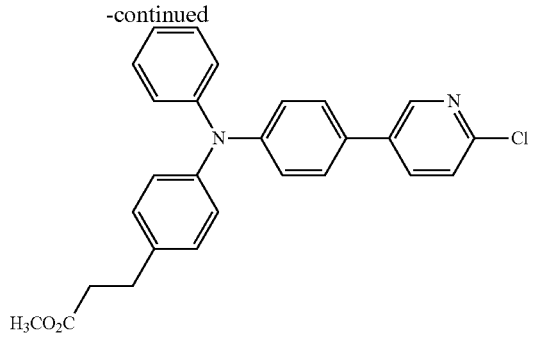

TAA-2

Furthermore, in a nitrogen atmosphere, triphenylphosphine (9.5 g) and nickel (II) chloride (1.5 g) are dissolved in anhydrous DMF (40 ml), and the solution is heated to 50° C. and stirred. Zinc (0.6 g) and TAA-2 (3.9 g) are added thereto, and the mixture is heated and stirred for 4 hours at 50° C. After completion of the reaction, the reaction solution is transferred to a separatory funnel, water and chloroform are added thereto, and the mixture is partitioned. Furthermore, the aqueous layer is extracted with chloroform, and the organic layer is suction filtered. The filtrate is dried over sodium sulfate. The solvent is distilled off under reduced pressure, water is added thereto, and the mixture is suction filtered to obtain a crude product. This crude product is washed with an aqueous EDTA solution, and then is purified by column chromatography (hexane/ethyl acetate=2/1). Thus, 1.5 g of a monomer compound (14) is obtained.

It is confirmed by a $^1$H-NMR spectroscopic analysis and an IR spectroscopic analysis that the compound thus obtained is monomer compound (14).

Synthesis Example 2

Synthesis of Polymer Compound (15)

1.0 g of the monomer compound (14) thus obtained is used, and ethylene glycol (10 ml) and tetrabutoxytitanium (0.02 g) are introduced into a 50-ml three-necked pear-shaped flask. The mixture is heated and stirred for 5 hours at 200° C. in a nitrogen atmosphere. After it is confirmed by thin layer chromatography (TLC) that the raw material monomer compound (14) has reacted and disappeared, the reaction mixture is

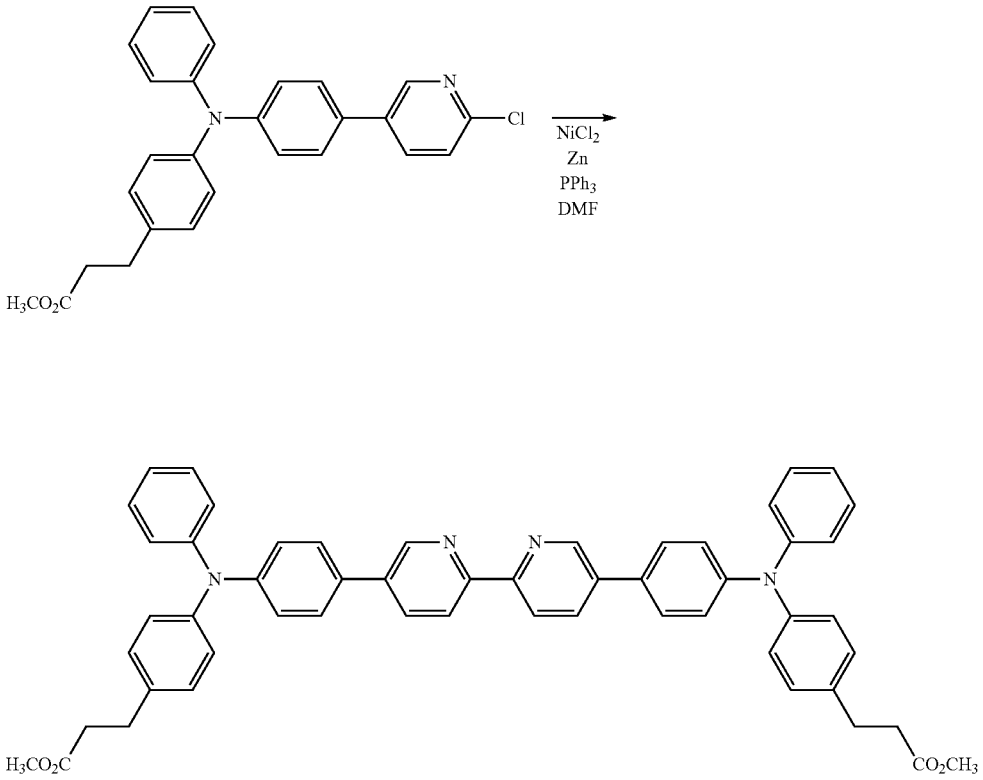

Monomer compound 14 heated to 210° C. while ethylene glycol is distilled off by lowering the pressure to 50 Pa, and the reaction is continued for 6 hours.

Thereafter, the reaction mixture is cooled to room temperature (25° C.), and is dissolved in 50 ml of tetrahydrofuran. Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer.

The polymer thus obtained is filtered, washed with methanol, and then dried in a vacuum for 16 hours at 60° C. Thus, 0.7 g of a polymer [polymer compound: (15)] is obtained.

The molecular weight of this polymer is measured by gel permeation chromatography (GPC) (manufactured by Tosoh Corp., HLC-8120GPC), and it is found that the weight average molecular weight $Mw=3.7\times10^4$ (in terms of styrene), and $Mw/Mn=2.22$. The degree of polymerization, p, determined from the molecular weight of the raw material polymer compound having a small molecular weight (monomer compound) is about 62.

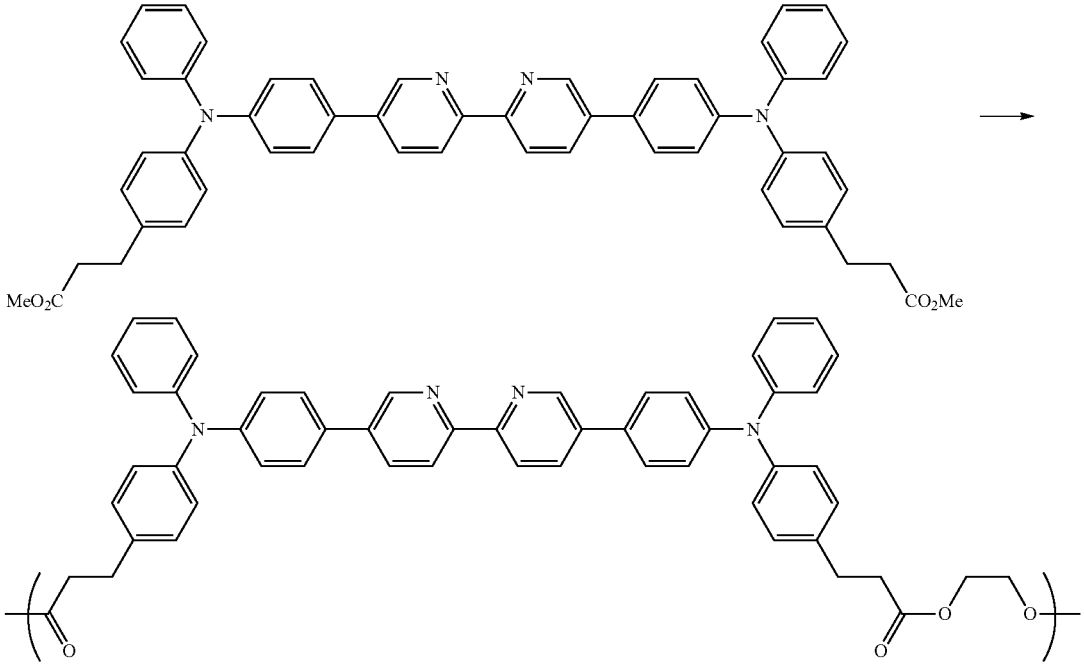

Polymer compound 15

Synthesis Example 3

Synthesis of Monomer Compound (15)

4-Methylacetanilide (21.0 g), methyl 4-iodophenylpropionate (64.4 g), potassium carbonate (38.3 g), copper sulfate pentahydrate (2.3 g), and n-tridecane (50 ml) are introduced into a 500-ml three-necked flask, and the mixture is heated and stirred for 20 hours at 230° C. under a nitrogen gas stream.

After completion of the reaction, potassium hydroxide (15.6 g) dissolved in ethylene glycol (300 ml) is added thereto, and the mixture is heated to reflux for 3.5 hours under a nitrogen gas stream. Subsequently, the reaction liquid is cooled to room temperature (25° C.), and the reaction liquid is poured into 1 L of distilled water and neutralized with hydrochloric acid. Thus, crystals are precipitated out. The crystals are filtered by suction filtration, washed with water, and then transferred into a 1-L flask. Toluene (500 ml) is added to these crystals, and the mixture is heated to reflux. Water is removed by azeotropically boiling the mixture, and then a methanol (300 ml) solution of concentrated sulfuric acid (1.5 ml) is added thereto. The mixture is heated to reflux for 5 hours under a nitrogen gas stream.

After the reaction, the reaction mixture is extracted with toluene, and the organic layer is washed with pure water. Subsequently, the organic layer is dried over anhydrous sodium sulfate, and then the solvent is distilled off under reduced pressure. The residue is recrystallized from hexane, and thus DAA-2 (34.1 g) is obtained.

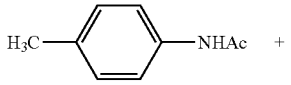

-continued

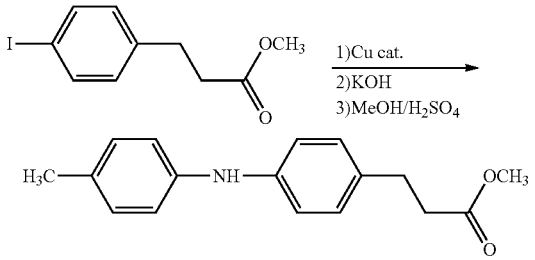

DAA-2

Subsequently, a liquid mixture of 1-bromo-4-iodobenzene (22.8 g), DAA-2 (20.0 g), copper (II) sulfate pentahydrate (1.0 g), potassium carbonate (5.2 g), and tridecane (20 ml) is stirred for 7 hours at 210° C.

After completion of the reaction, potassium hydroxide (15.6 g) dissolved in ethylene glycol (300 ml) is added thereto, and the reaction mixture is heated to reflux for 3.5 hours under a nitrogen gas stream. Subsequently, the reaction liquid is cooled to room temperature (25° C.), and the reaction liquid is poured into 1 L of distilled water and neutralized with hydrochloric acid. Thus, crystals are precipitated out. The crystals are filtered by suction filtration, washed with water, and then transferred into a 1-L flask. Toluene (500 ml) is added to these crystals, and the mixture is heated to reflux. Water is removed by azeotropically boiling the mixture, and then a methanol (300 ml) solution of concentrated sulfuric acid (1.5 ml) is added thereto. The mixture is heated to reflux for 5 hours under a nitrogen gas stream.

The mixture is cooled to room temperature (25° C.), toluene is added thereto, and the mixture is filtered through Celite. The filtrate is washed with pure water, the organic layer is extracted, and the organic solvent is distilled off. A product thus obtained is separated by silica gel column chromatography (hexane 4:toluene 1), and thus, TAA-3 (16.1 g) is obtained.

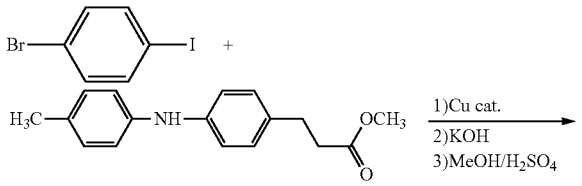

-continued

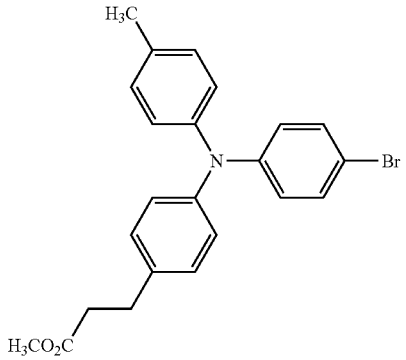

TAA-3

Subsequently, under a nitrogen atmosphere, TAA-3 (14.2 g), tetrakis(triphenylphosphine)palladium(0) (1.1 g), ethanol (30 ml), 2 M sodium carbonate (30 ml), 2-chloro-5-(5,5-dimethyl-1,3,2-dioxaborinan-2-yl)pyridine (11.4 g) are dissolved in toluene, and the solution is refluxed and stirred for 8 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and a crude product is obtained. This crude product is purified by column chromatography (hexane/ethyl acetate=5/1), and thus TAA-4 (5.2 g) is obtained.

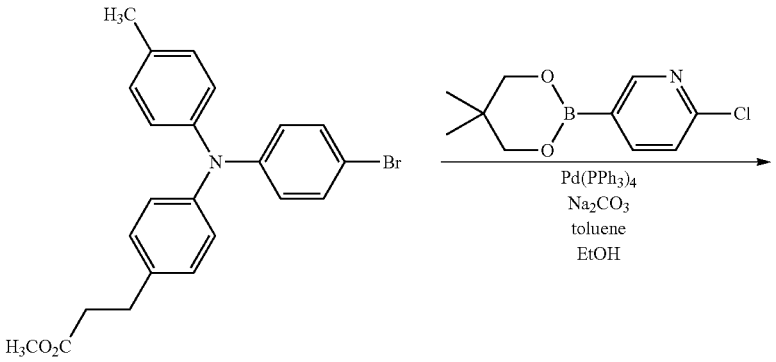

TAA-3

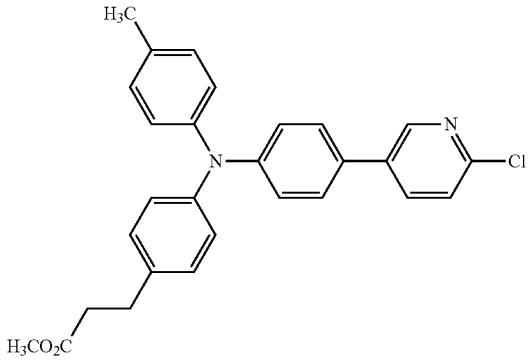

TAA-4

Furthermore, in a nitrogen atmosphere, triphenylphosphine (9.5 g) and nickel (II) chloride (1.5 g) are dissolved in anhydrous DMF (50 ml), and the solution is heated to 50° C. and stirred. Zinc (0.6 g) and TAA-4 (4.0 g) are added thereto, and the mixture is heated and stirred for 4 hours at 50° C.

After completion of the reaction, the reaction solution is transferred to a separatory funnel, water and chloroform are added thereto, and the mixture is partitioned. Furthermore, the aqueous layer is extracted with chloroform, and the organic layer thus obtained is suction filtered. Sodium sulfate is added to the filtrate to dry the filtrate. The solvent is distilled off under reduced pressure, water is added thereto, and the mixture is suction filtered. Thus, a crude product is obtained. This is washed with an aqueous EDTA solution, and then is purified by column chromatography (hexane/ethyl acetate=2/1). Thus, 1.3 g of a monomer compound (15) is obtained.

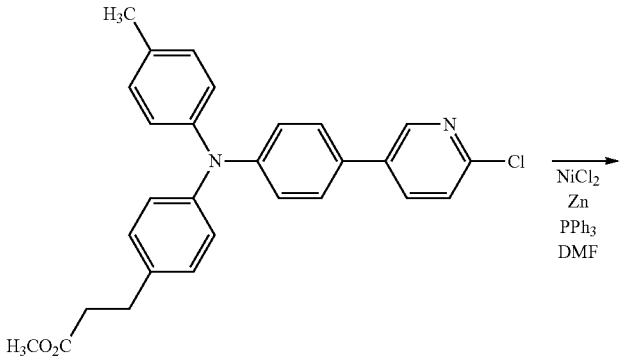

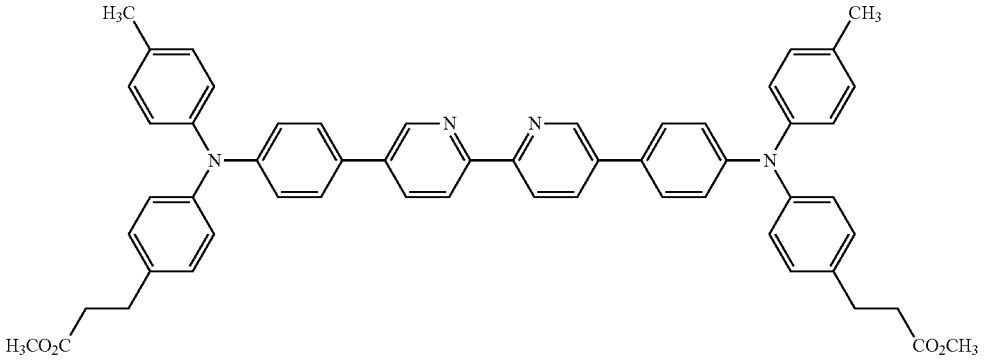

Monomer compound 15

It is confirmed by a $^{1}$H-NMR spectroscopic analysis and an IR spectroscopic analysis that the compound thus obtained is monomer compound (15).

Synthesis Example 4

Synthesis of Polymer Compound (17)

The monomer compound (15) thus obtained (1.0 g), ethylene glycol (10 ml) and tetrabutoxytitanium (0.02 g) are introduced into a 50-ml three-necked pear-shaped flask, and in a nitrogen atmosphere, the mixture is heated and stirred for 6 hours at 200° C. After it is confirmed by TLC that the raw material monomer compound (15) has reacted and disappeared, the reaction mixture is heated to 210° C. while ethylene glycol is distilled off by lowering the pressure to 50 Pa, and the reaction is continued for 6 hours.

Thereafter, the reaction mixture is cooled to room temperature (25° C.), and is dissolved in tetrahydrofuran (50 ml). Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer. The polymer thus obtained is filtered, washed with methanol, and then dried in a vacuum for 16 hours at 60° C. Thus, 0.6 g of a polymer [polymer compound: (17)] is obtained.

The molecular weight of this polymer is measured by gel permeation chromatography (GPC) (manufactured by Tosoh Corp., HLC-8120GPC), and it is found that Mw=$4.6\times10^4$ (in terms of styrene), and Mw/Mn=2.15. The degree of polymerization, p, determined from the molecular weight of the monomer is about 45.

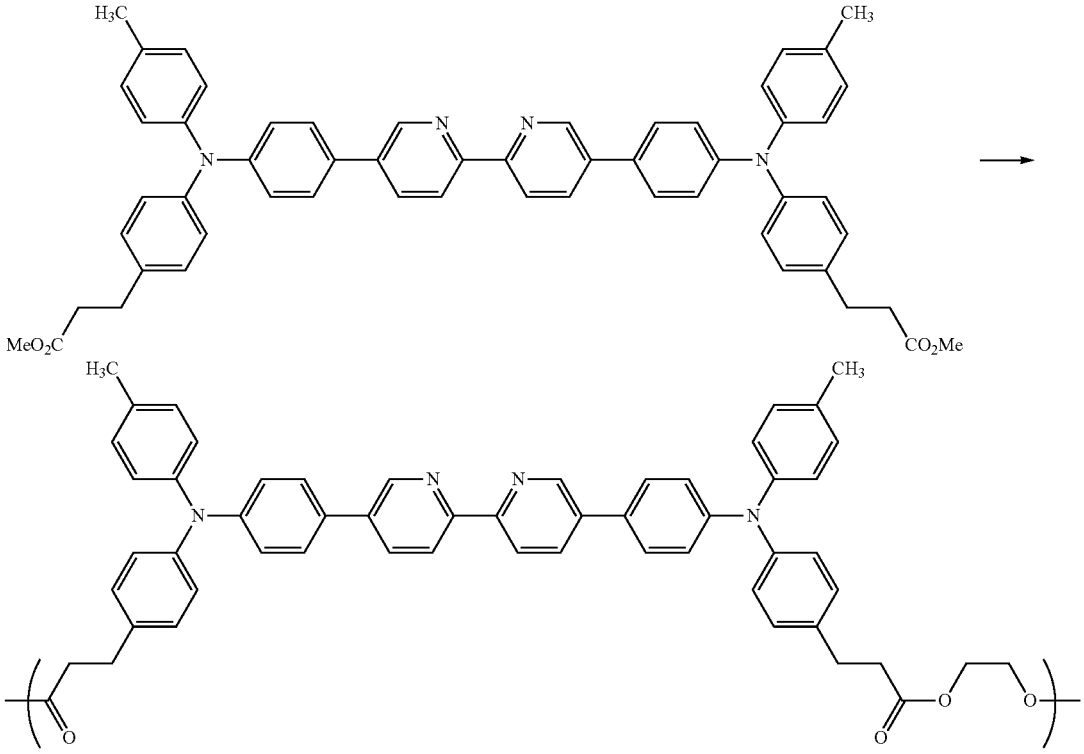

Polymer compound 17

Synthesis Example 5

Synthesis of Monomer Compound (24)

1-Acetamidonaphthalene (25.0 g), methyl 4-iodophenylpropionate (64.4 g), potassium carbonate (38.3 g), copper sulfate pentahydrate (2.3 g) and n-tridecane (50 ml) are introduced into a 500-ml three-necked flask, and the mixture is heated and stirred for 20 hours at 230° C. under a nitrogen gas stream.

After completion of the reaction, potassium hydroxide (15.6 g) dissolved in ethylene glycol (300 ml) is added thereto, and the mixture is heated to reflux for 3.5 hours under a nitrogen gas stream. Subsequently, the reaction liquid is cooled to room temperature (25° C.), and the reaction liquid is poured into 1 L of distilled water and neutralized with hydrochloric acid. Thus, crystals are precipitated out. The crystals are filtered by suction filtration, washed with water, and then transferred into a 1-L flask. Toluene (500 ml) is added to these crystals, and the mixture is heated to reflux. Water is removed by azeotropically boiling the mixture, and then a methanol (300 ml) solution of concentrated sulfuric acid (1.5 ml) is added thereto. The mixture is heated to reflux for 5 hours under a nitrogen gas stream.

After the reaction, the reaction mixture is extracted with toluene, and the organic layer is washed with pure water. Subsequently, the organic layer is dried over anhydrous sodium sulfate, and then the solvent is distilled off under reduced pressure. The residue is recrystallized from hexane, and thus DAA-3 (36.5 g) is obtained.

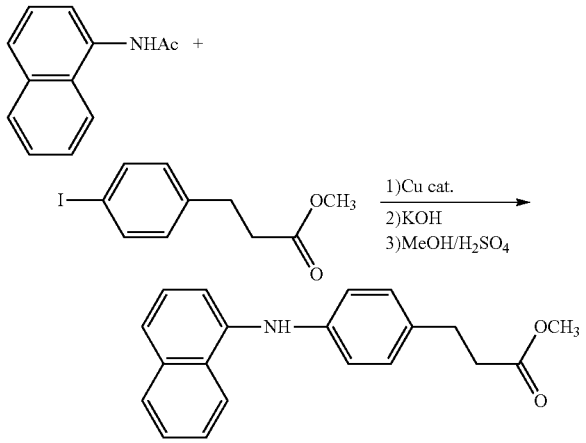

DAA-3

Subsequently, a liquid mixture of 1-bromo-4-iodobenzene (20.3 g), DAA-3 (20.0 g), copper (II) sulfate pentahydrate (1.0 g), potassium carbonate (5.2 g), and tridecane (20 ml) is stirred for 12 hours at 210° C.

After completion of the reaction, potassium hydroxide (15.6 g) dissolved in ethylene glycol (300 ml) is added thereto, and the mixture is heated to reflux for 3.5 hours under a nitrogen gas stream. Subsequently, the reaction liquid is cooled to room temperature (25° C.), and the reaction liquid is poured into 1 L of distilled water and neutralized with hydrochloric acid. Thus, crystals are precipitated out. The crystals are filtered by suction filtration, washed with water, and then transferred into a 1-L flask. Toluene (500 ml) is added to these crystals, and the mixture is heated to reflux. Water is removed by azeotropically boiling the mixture, and then a methanol (300 ml) solution of concentrated sulfuric acid (1.5 ml) is added thereto. The mixture is heated to reflux for 5 hours under a nitrogen gas stream.

The mixture is cooled to room temperature (25° C.), toluene is added thereto, and the mixture is filtered through Celite. The filter cake is washed with pure water, and the organic layer is extracted. The organic solvent is distilled off, and a product thus obtained is separated by silica gel column chromatography (hexane 4:toluene 1). Thus, TAA-5 (17.2 g) is obtained.

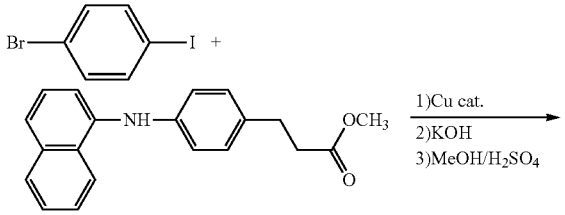

DAA-3

-continued

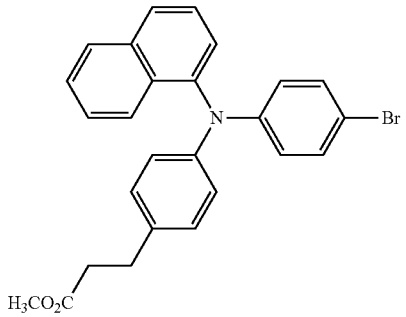

TAA-5

Subsequently, under a nitrogen atmosphere, TAA-5 (15.3 g), tetrakis(triphenylphosphine)palladium(0) (11.1 g), ethanol (30 ml), 2 M sodium carbonate (30 ml), and 2-chloro-5-(5,5-dimethyl-1,3,2-dioxaborinan-2-yl)pyridine (11.4 g) are dissolved in toluene, and the solution is refluxed and stirred for 10 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and a crude product is obtained. This crude product is purified by column chromatography (hexane/ethyl acetate=5/1), and thus TAA-6 (5.5 g) is obtained.

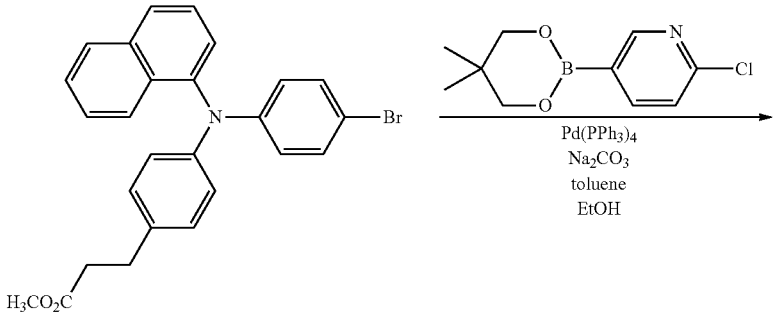

TAA-5

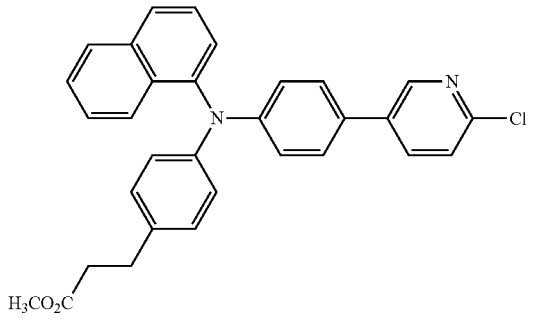

TAA-6

Furthermore, in a nitrogen atmosphere, triphenylphosphine (9.5 g) and nickel (II) chloride (1.5 g) are dissolved in anhydrous DMF (40 ml), and the solution is heated to 50° C. and stirred. Zinc (0.6 g) and TAA-6 (4.3 g) are added thereto, and the mixture is heated and stirred for 4 hours at 50° C.

After completion of the reaction, the reaction solution is transferred to a separatory funnel, water and chloroform are added thereto, and the mixture is partitioned. Furthermore, the aqueous layer is extracted with chloroform, and the organic layer thus obtained is suction filtered. Sodium sulfate is added to the filtrate to dry the filtrate. The solvent is distilled off under reduced pressure, water is added thereto, and the mixture is suction filtered. Thus, a crude product is obtained. This is washed with an aqueous EDTA solution, and then is purified by column chromatography (hexane/ethyl acetate=2/1). Thus, 1.1 g of a monomer compound (24) is obtained.

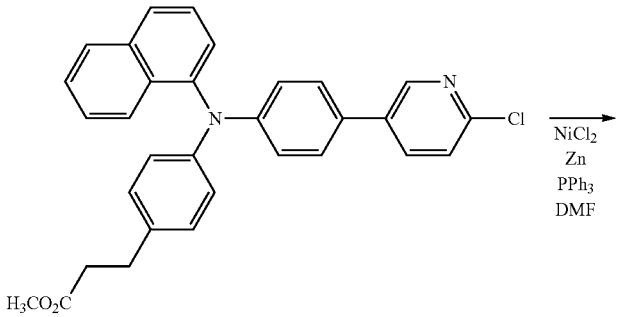

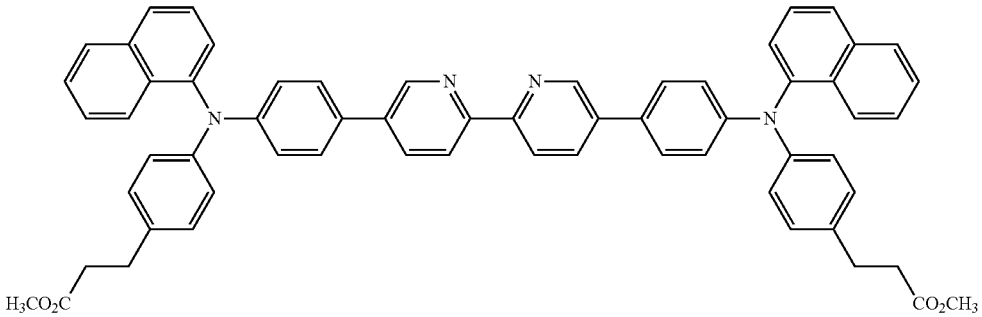

Monomer compound 24

It is confirmed by a $^1$H-NMR spectroscopic analysis and an IR spectroscopic analysis that the compound thus obtained is monomer compound (24).

Synthesis Example 6

Synthesis of Polymer Compound (27)

The monomer compound (24) thus obtained (1.0 g), ethylene glycol (10 ml) and tetrabutoxytitanium (0.02 g) are introduced into a 50-ml three-necked pear-shaped flask, and in a nitrogen atmosphere, the mixture is heated and stirred for 7 hours at 200° C. After it is confirmed by TLC that the raw material monomer compound (24) has reacted and disappeared, the reaction mixture is heated to 210° C. while ethylene glycol is distilled off by lowering the pressure to 50 Pa, and the reaction is continued for 6 hours.

Thereafter, the reaction mixture is cooled to room temperature (25° C.), and is dissolved in 50 ml of tetrahydrofuran. Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer. The polymer thus obtained is filtered, washed with methanol, and then dried in a vacuum for 16 hours at 60° C. Thus, 0.5 g of a polymer [polymer compound: (27)] is obtained.

The molecular weight of this polymer is measured by gel permeation chromatography (GPC) (manufactured by Tosoh Corp., HLC-8120GPC), and it is found that Mw=6.0×10$^4$ (in terms of styrene), and Mw/Mn=2.15. The degree of polymerization, p, determined from the molecular weight of the monomer is about 42.

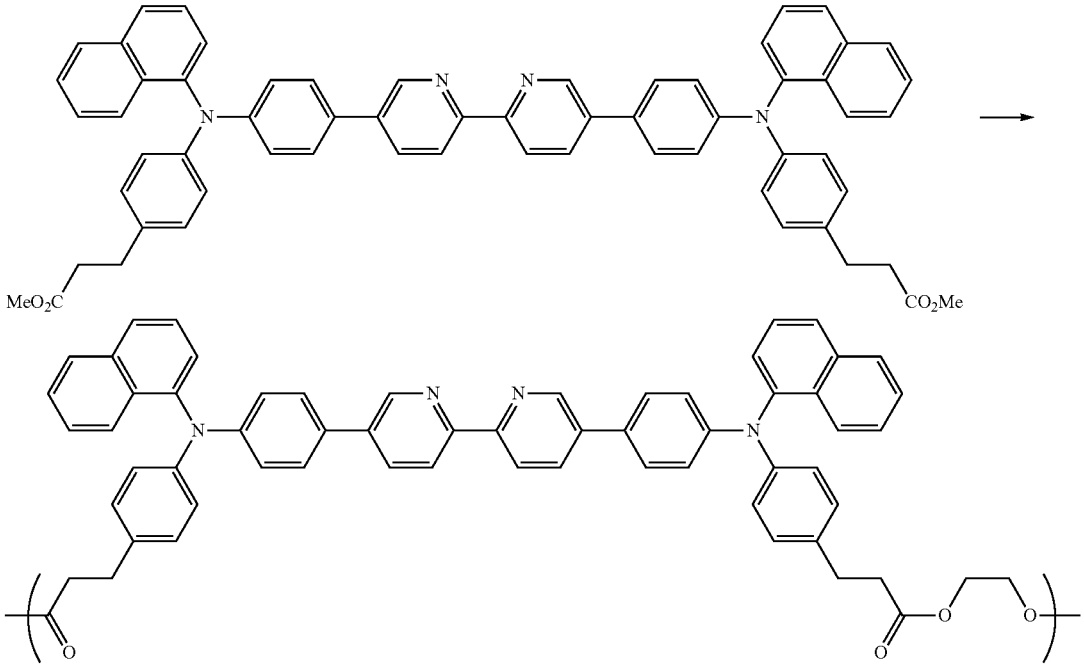

Polymer compound 27

Synthesis Example 7

Synthesis of Monomer Compound (23)

In a nitrogen atmosphere, a liquid mixture of 1-bromo-4-iodobenzene (19.2 g), DAA-4 (20.0 g), copper(II) sulfate pentahydrate (1.0 g), potassium carbonate (5.2 g), and tridecane (25 ml) is stirred for 18 hours at 210° C.

After completion of the reaction, potassium hydroxide (15.6 g) dissolved in ethylene glycol (300 ml) is added thereto, and the mixture is heated to reflux for 3.5 hours under a nitrogen gas stream. Subsequently, the reaction liquid is cooled to room temperature (25° C.), and the reaction liquid is poured into 1 L of distilled water and neutralized with hydrochloric acid. Thus, crystals are precipitated out. The crystals are filtered by suction filtration, washed with water, and then transferred into a 1-L flask. Toluene (500 ml) is added to these crystals, and the mixture is heated to reflux. Water is removed by azeotropically boiling the mixture, and then a methanol (300 ml) solution of concentrated sulfuric acid (1.5 ml) is added thereto. The mixture is heated to reflux for 5 hours under a nitrogen gas stream.

The mixture is cooled, toluene is added thereto, and the mixture is filtered through Celite. The product obtained by distilling off toluene is separated by silica gel column chromatography (hexane 2:toluene 1). Thus, TAA-7 (14.5 g) is obtained.

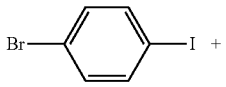

-continued

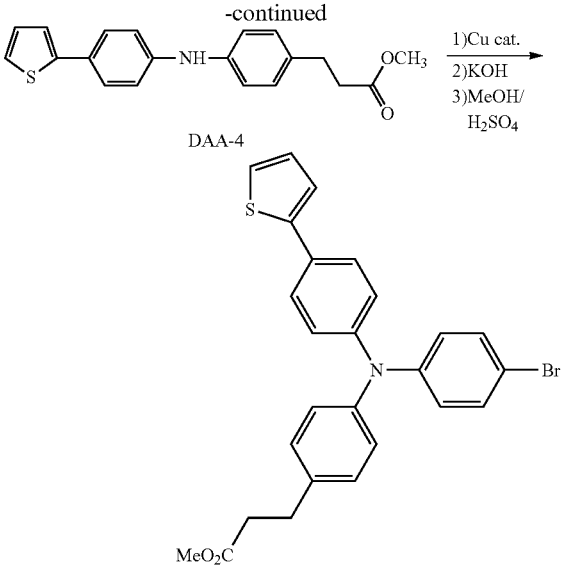

DAA-4

TAA-7

Subsequently, in a nitrogen atmosphere, TAA-7 (16.4 g), tetrakis(triphenylphosphine)palladium(0) (1.1 g), ethanol (30 ml), 2 M sodium carbonate (30 ml), and 2-chloro-5-(5,5-dimethyl-1,3,2-dioxaborinan-2-yl)pyridine (11.4 g) are dissolved in toluene, and the solution is refluxed and stirred for 8 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and thus a crude product is obtained. This is purified by column chromatography (hexane/ethyl acetate=5/1), and thus TAA-8 (5.8 g) is obtained.

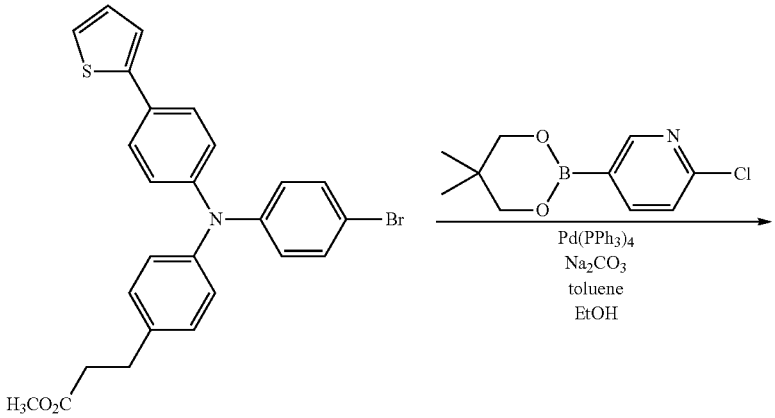

TAA-7

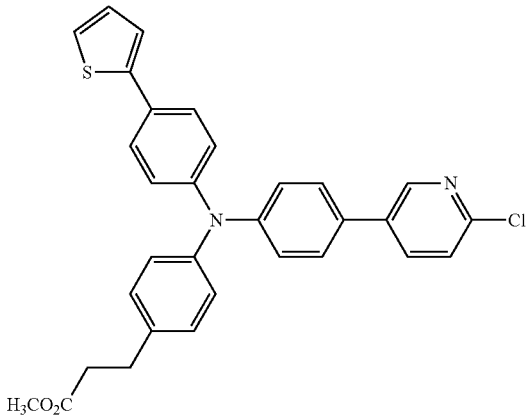

TAA-8

Furthermore, in a nitrogen atmosphere, triphenylphosphine (9.5 g) and nickel (II) chloride (1.5 g) are dissolved in anhydrous DMF (40 ml), and the solution is heated to 50° C. and stirred. Zinc (0.6 g) and TAA-8 (4.6 g) are added thereto, and the mixture is heated and stirred for 4 hours at 50° C.

After completion of the reaction, the reaction solution is transferred to a separatory funnel, and water and chloroform are added thereto, and the reaction mixture is partitioned. Furthermore, the aqueous layer is extracted with chloroform, and the organic layer thus obtained is suction filtered. Sodium sulfate is added to the filtrate to dry the filtrate. The solvent is distilled off under reduced pressure, water is added thereto, and the mixture is suction filtered. Thus, a crude product is obtained. This crude product is washed with an aqueous EDTA solution, and then is purified by column chromatography (hexane/ethyl acetate=2/1). Thus, 1.3 g of a monomer compound (23) is obtained.

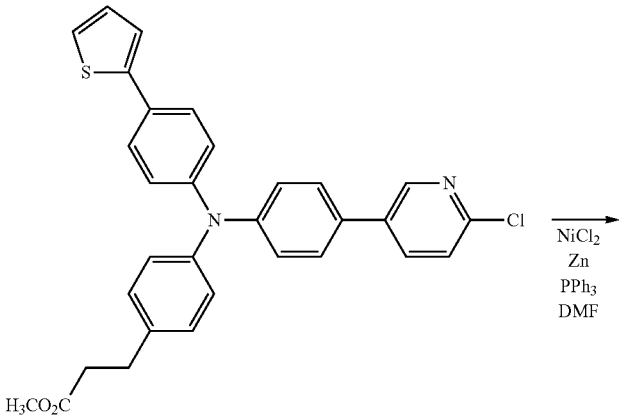

-continued

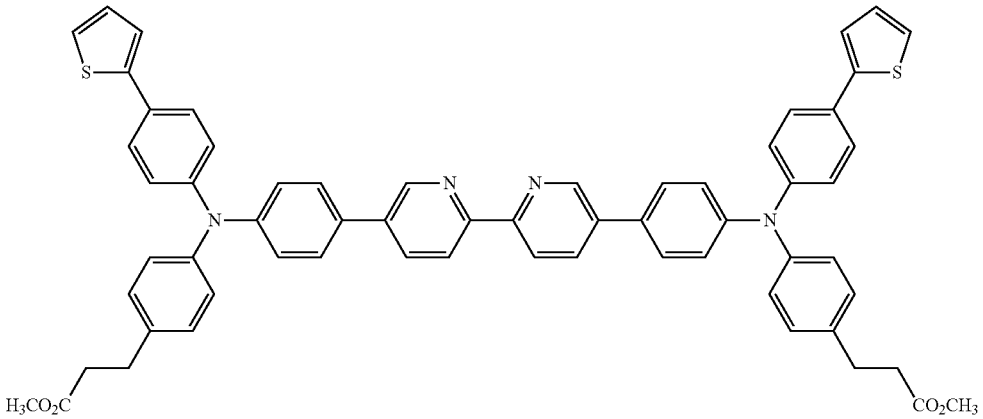

Monomer compound 23

It is confirmed by a $^1$H-NMR spectroscopic analysis and an IR spectroscopic analysis that the compound thus obtained is monomer compound (23).

Synthesis Example 8

Synthesis of Polymer Compound (26)

The monomer compound (23) thus obtained (1.0 g), ethylene glycol (10 ml) and tetrabutoxytitanium (0.02 g) are introduced into a 50-ml three-necked pear-shaped flask, and in a nitrogen atmosphere, the mixture is heated and stirred for 5 hours at 200° C. After it is confirmed by TLC that the raw material monomer compound (23) has reacted and disappeared, the reaction mixture is heated to 210° C. while ethylene glycol is distilled off by lowering the pressure to 50 Pa, and the reaction is continued for 6 hours. Thereafter, the reaction mixture is cooled to room temperature (25° C.), and is dissolved in 50 ml of tetrahydrofuran. Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer. The polymer thus obtained is filtered, washed with methanol, and then dried in a vacuum for 16 hours at 60° C. Thus, 0.7 g of a polymer [polymer compound: (26)] is obtained.

The molecular weight of this polymer is measured by gel permeation chromatography (GPC) (manufactured by Tosoh Corp., HLC-8120GPC), and it is found that Mw=$4.7\times10^4$ (in terms of styrene), and Mw/Mn=2.43. The degree of polymerization, p, determined from the molecular weight of the monomer is about 62.

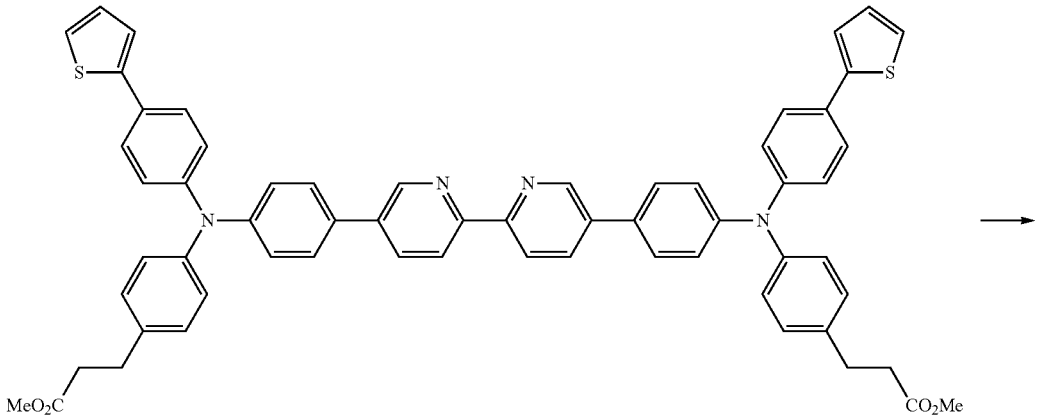

-continued

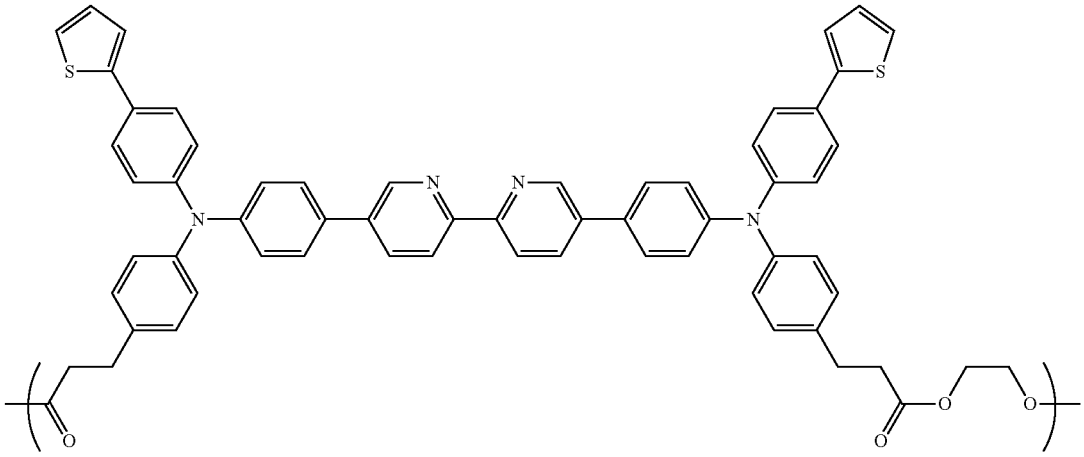

Polymer compound 26

Synthesis Example 9

Synthesis of Monomer Compound (16)

A liquid mixture of 1-bromo-4-iodobenzene (21.0 g), DAA-5 (20.0 g), copper(II) sulfate pentahydrate (1.0 g), potassium carbonate (5.2 g) and tridecane (20 ml) is stirred for 7 hours at 210° C.

After completion of the reaction, potassium hydroxide (15.6 g) dissolved in ethylene glycol (300 ml) is added to the reaction liquid, and the mixture is heated to reflux for 3.5 hours under a nitrogen gas stream and then cooled to room temperature (25° C.). The reaction liquid is poured into 1 L of distilled water, and is neutralized with hydrochloric acid, and crystals are precipitated. The crystals are collected by suction filtration, washed with water, and then transferred to a 1-L flask. Toluene (500 ml) is added to the crystals, and the mixture is heated to reflux. Water is removed by azeotropically boiling the mixture, and then a methanol (300 ml) solution of concentrated sulfuric acid (1.5 ml) is added to the resultant. The mixture is heated to reflux for 5 hours under a nitrogen gas stream.

The reaction mixture is cooled to room temperature (25° C.), toluene is added thereto, and the mixture is filtered through Celite. The filtrate is washed with pure water, and the organic layer is extracted. The organic solvent is distilled off, and a product thus obtained is separated by silica gel column chromatography (hexane 4:toluene 1). Thus, TAA-9 (14.3 g) is obtained.

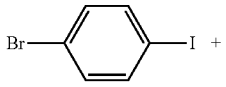

-continued

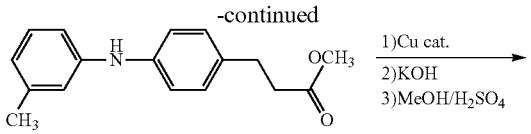

DAA-5

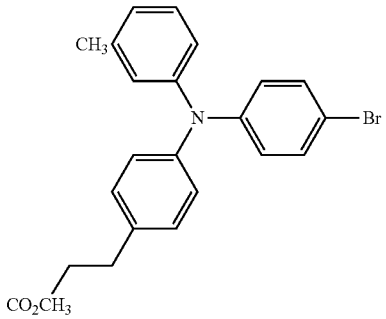

TAA-9

Subsequently, under a nitrogen atmosphere, TAA-9 (14.2 g), tetrakis(triphenylphosphine)palladium(0) (1.1 g), ethanol (30 ml), 2 M sodium carbonate (30 ml), and 2-chloro-5-(5,5-dimethyl-1,3,2-dioxaborinan-2-yl)pyridine (11.4 g) are dissolved in toluene, and the solution is refluxed and stirred for 6 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and a crude product is obtained. This crude product is purified by column chromatography (hexane/ethyl acetate=5/1), and thus TAA-10 (4.1 g) is obtained.

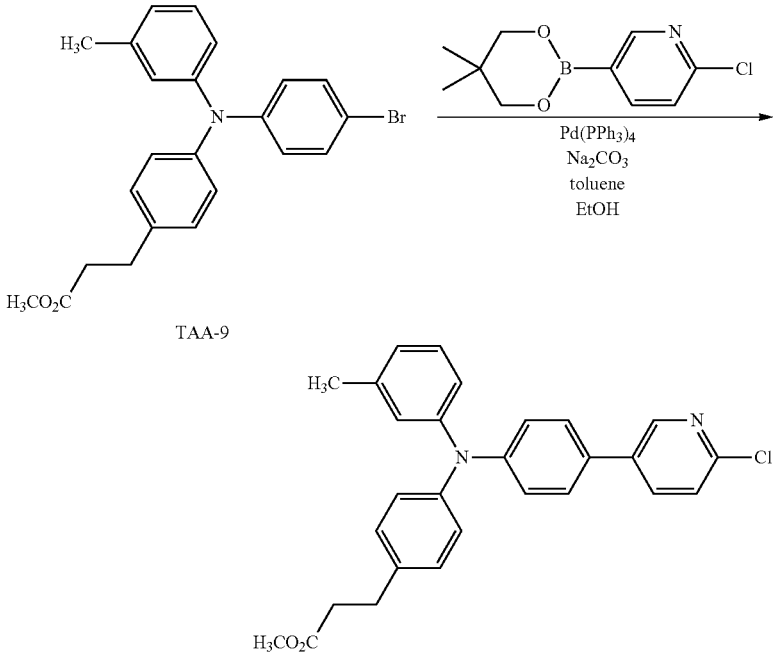

Furthermore, in a nitrogen atmosphere, triphenylphosphine (9.5 g) and nickel (II) chloride (1.5 g) are dissolved in and anhydrous DMF (40 ml), and the solution is heated to 50° C. and stirred. Zinc (0.6 g) and TAA-10 (3.9 g) are added thereto, and the mixture is heated and stirred for 4 hours at 50° C.

After completion of the reaction, the reaction solution is transferred to a separatory funnel, water and chloroform are added thereto, and the mixture is partitioned. Furthermore, the aqueous layer is extracted with chloroform, and the organic layer is suction filtered. The filtrate is dried over sodium sulfate. The solvent is distilled off under reduced pressure, water is added thereto, and the mixture is suction filtered to obtain a crude product. This crude product is washed with an aqueous EDTA solution, and then is purified by column chromatography (hexane/ethyl acetate=2/1). Thus, 1.4 g of a monomer compound (16) is obtained.

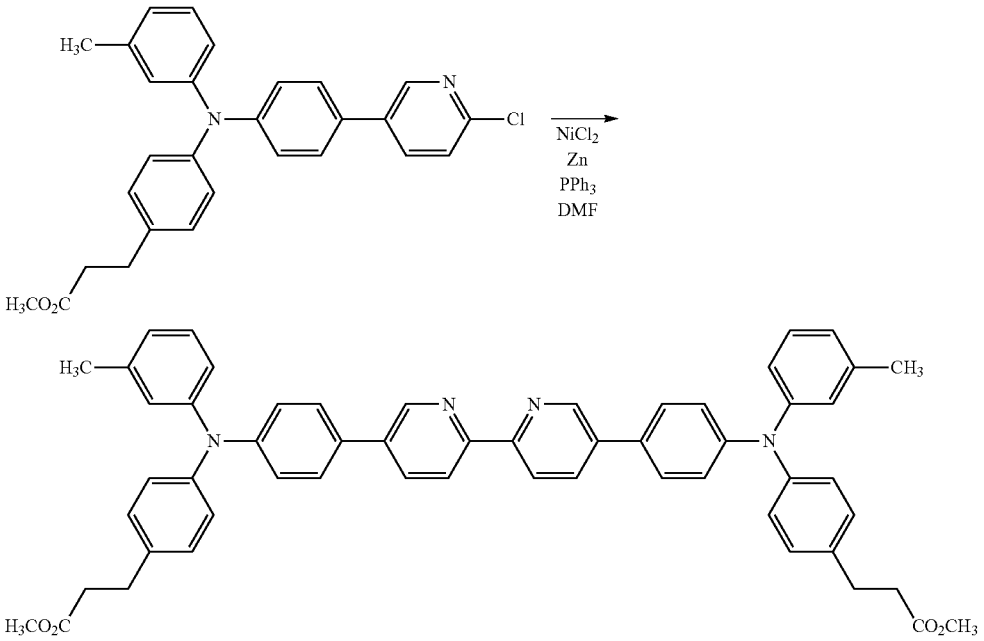

Monomer compound 16

It is confirmed by a $^1$H-NMR spectroscopic analysis and an IR spectroscopic analysis that the compound thus obtained is monomer compound (16).

Synthesis Example 10

Synthesis of Polymer Compound (18)

The monomer compound (16) thus obtained (1.0 g), ethylene glycol (10 ml) and tetrabutoxytitanium (0.02 g) are introduced into a 50-ml three-necked pear-shaped flask, and in a nitrogen atmosphere, the mixture is heated and stirred for 5 hours at 200° C. After it is confirmed by TLC that the raw material monomer compound (16) has reacted and disappeared, the reaction mixture is heated to 210° C. while ethylene glycol is distilled off by lowering the pressure to 50 Pa, and the reaction is continued for 6 hours. Thereafter, the reaction mixture is cooled to room temperature (25° C.), and is dissolved in tetrahydrofuran (50 ml). Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer. The polymer thus obtained is filtered, washed with methanol, and then dried in a vacuum for 16 hours at 60° C. Thus, 0.7 g of a polymer [polymer compound: (18)] is obtained.

The molecular weight of this polymer is measured by gel permeation chromatography (GPC) (manufactured by Tosoh Corp., HLC-8120GPC), and it is found that Mw=6.1×10$^4$ (in terms of styrene), and Mw/Mn=2.31. The degree of polymerization, p, determined from the molecular weight of the monomer is about 48.

Synthesis Example 11

Synthesis of Monomer Compound (22)

In a nitrogen atmosphere, a liquid mixture of 3-bromobiphenyl (26.3 g), DAA-6 (28.0 g), copper(II) sulfate pentahydrate (1.2 g), potassium carbonate (7.3 g), and tridecane (30 ml) is stirred for 20 hours at 210° C.

After completion of the reaction, potassium hydroxide (15.6 g) dissolved in ethylene glycol (300 ml) is added to the reaction liquid, and the mixture is heated to reflux for 3.5 hours under a nitrogen gas stream and then cooled to room temperature (25° C.). The reaction liquid is poured into 1 L of distilled water, and is neutralized with hydrochloric acid, and crystals are precipitated. The crystals are collected by suction filtration, washed with water, and then transferred to a 1-L flask. Toluene (500 ml) is added to the crystals, and the mixture is heated to reflux. Water is removed by azeotropically boiling the mixture, and then a methanol (300 ml) solution of concentrated sulfuric acid (1.5 ml) is added to the resultant. The mixture is heated to reflux for 5 hours under a nitrogen gas stream.

After the mixture is cooled, toluene is added thereto, and the mixture is filtered through Celite. A product obtained by distilling off toluene is separated by silica gel column chromatography (toluene). Thus, TAA-11 (18.5 g) is obtained.

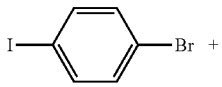

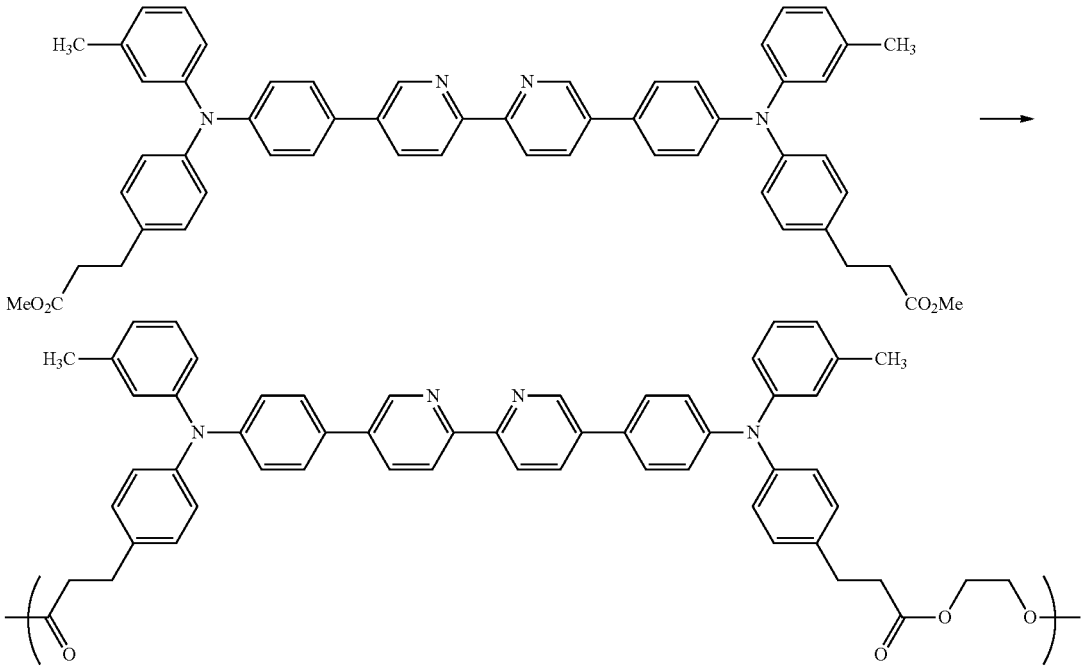

Polymer compound 18

-continued

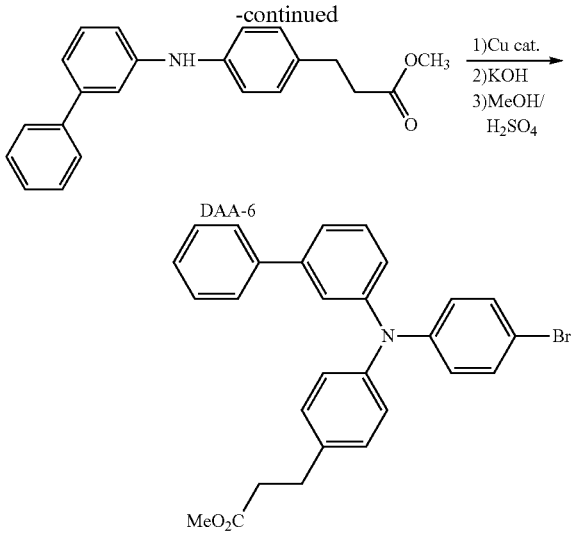

Subsequently, in a nitrogen atmosphere, TAA-11 (16.2 g), tetrakis(triphenylphosphine)palladium(0) (1.1 g), ethanol (30 ml), 2 M sodium carbonate (30 ml), and 2-chloro-5-(5,5-dimethyl-1,3,2-dioxaborinan-2-yl)pyridine (11.4 g) are dissolved in toluene, and the solution is refluxed and stirred for 6 hours.

After completion of the reaction, the reaction solution is transferred to a separatory funnel, water and toluene are added thereto, and the mixture is partitioned. The organic layer is washed with saturated brine, and then is dried over sodium sulfate. The solvent is distilled off under reduced pressure, and a crude product is obtained. This crude product is purified by column chromatography (hexane/ethyl acetate=5/1), and thus TAA-12 (5.2 g) is obtained.

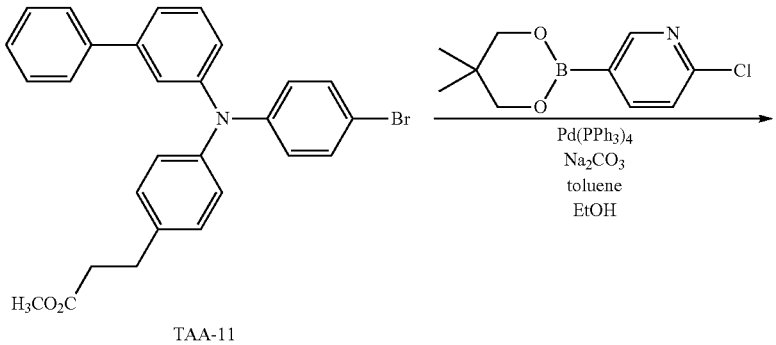

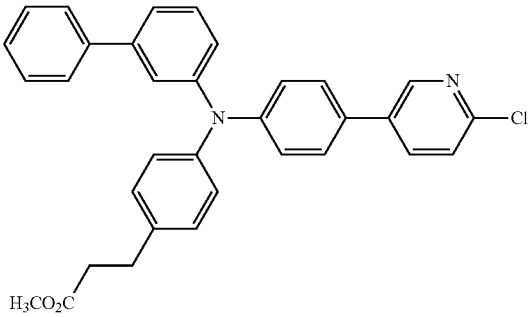

Furthermore, in a nitrogen atmosphere, triphenylphosphine (9.5 g) and nickel (II) chloride (1.5 g) are dissolved in anhydrous DMF (40 ml), and the solution is heated to 50° C. and stirred. Zinc (0.6 g) and TAA-12 (4.5 g) are added thereto, and the mixture is heated and stirred for 4 hours at 50° C.

After completion of the reaction, the reaction solution is transferred to a separatory funnel, water and chloroform are added thereto, and the mixture is partitioned. Furthermore, the aqueous layer is extracted with chloroform, and the organic layer thus obtained is suction filtered. Sodium sulfate is added to the filtrate to dry the filtrate. The solvent is distilled off under reduced pressure, water is added thereto, and the mixture is suction filtered. Thus, a crude product is obtained. This is washed with an aqueous EDTA solution, and then is purified by column chromatography (hexane/ethyl acetate=2/1). Thus, 1.2 g of a monomer compound (22) is obtained.

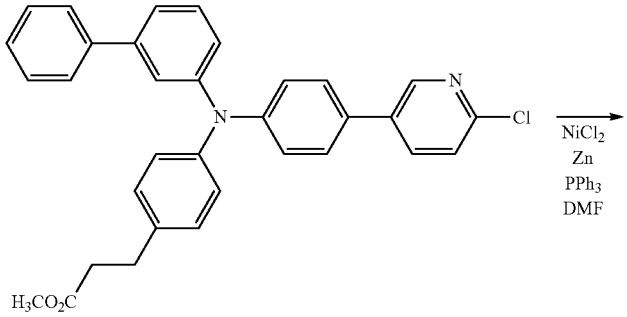

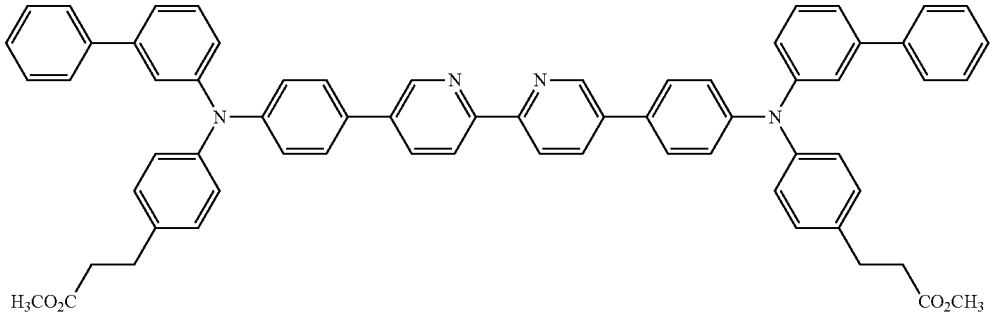

Monomer compound 22

It is confirmed by a $^1$H-NMR spectroscopic analysis and an IR spectroscopic analysis that the compound thus obtained is monomer compound (22).

Synthesis Example 12

Synthesis of Polymer Compound (25)

The monomer compound (22) thus obtained (1.0 g), ethylene glycol (10 ml) and tetrabutoxytitanium (0.02 g) are introduced into a 50-ml three-necked pear-shaped flask, and in a nitrogen atmosphere, the mixture is heated and stirred for 5 hours at 200° C. After it is confirmed by TLC that the raw material monomer compound (22) has reacted and disappeared, the reaction mixture is heated to 210° C. while ethylene glycol is distilled off by lowering the pressure to 50 Pa, and the reaction is continued for 6 hours. Thereafter, the reaction mixture is cooled to room temperature (25° C.), and is dissolved in tetrahydrofuran (50 ml). Insoluble substances are filtered through a 0.5-μm polytetrafluoroethylene (PTFE) filter, and the filtrate is distilled off under reduced pressure. The residue is dissolved in monochlorobenzene (300 ml), and is washed with 1 N HCl (300 ml) and 500 ml of water×3 in this order. The monochlorobenzene solution is distilled off under reduced pressure to 30 ml, and the solution is added dropwise to 800 ml of ethyl acetate/methanol=⅓, to reprecipitate a polymer. The polymer thus obtained is filtered, washed with methanol, and then dried in a vacuum for 16 hours at 60° C. Thus, 0.5 g of a polymer [polymer compound: (25)] is obtained.

The molecular weight of this polymer is measured by gel permeation chromatography (GPC) (manufactured by Tosoh Corp., HLC-8120GPC), and it is found that Mw=5.4×10$^4$ (in terms of styrene), and Mw/Mn=2.34. The degree of polymerization, p, determined from the molecular weight of the monomer is about 78.

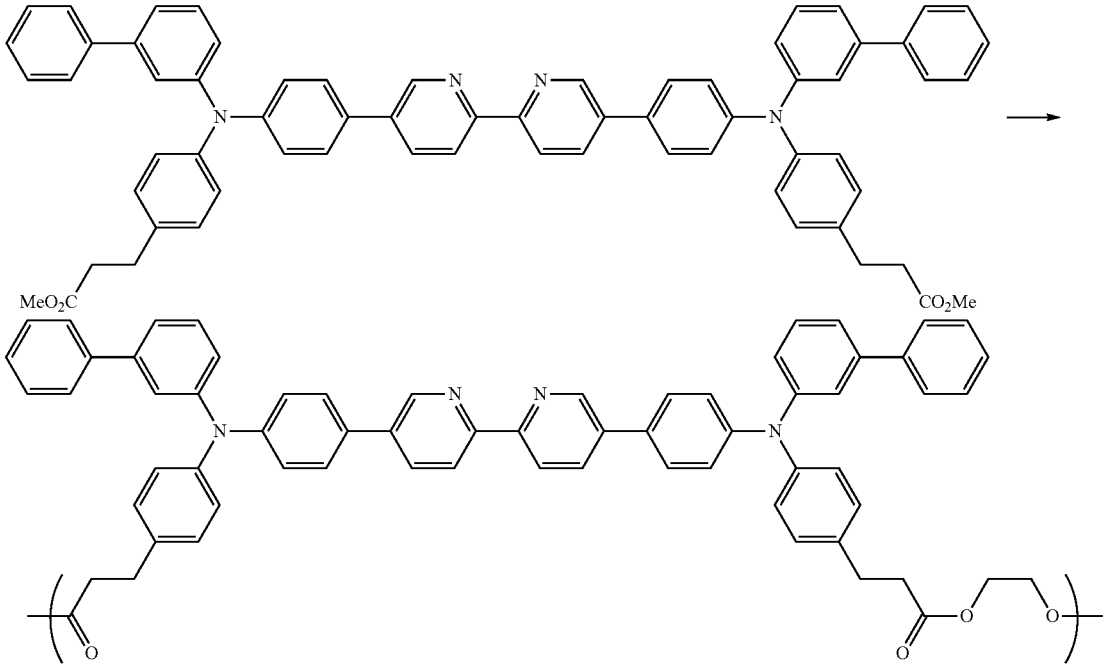

Polymer compound 25

Preparation of Image Holding Member for Image Forming Apparatus

Example 1

A solution formed from 10 parts by weight of a zirconium compound (ORGATIX ZC540, manufactured by Matsumoto Seiyaku K.K.), 1 part by weight of a silane compound (A1110, manufactured by Nippon Unicar Co., Ltd.), 40 parts by weight of i-propanol, and 20 parts by weight of butanol is applied on an aluminum substrate by a dip coating method, and the solution is heated to dry for 10 minutes at 150° C. Thus, an undercoat layer having a thickness of 0.6 μm is formed. One part by weight of chlorogallium phthalocyanine crystals having strong diffraction peaks at Bragg angles (2θ±0.2°) of 7.4°, 16.6°, 25.5° and 28.3° in the X-ray diffraction spectrum, is mixed with 1 part by weight of a polyvinyl butyral resin (S-LEC BM-S, manufactured by Sekisui Chemical Co., Ltd.) and 100 parts by weight of n-butyl acetate, and the mixture is dispersed by treating the mixture with a paint shaker together with glass beads for one hour. Subsequently, a coating liquid thus obtained is applied on the undercoat layer by a dip coating method, and is heated to dry for 10 minutes at 100° C. Thus, a charge generating layer is formed.

Subsequently, 2 parts by weight of the monomer compound 14 obtained as described above and 3 parts by weight of a bisphenol (Z) polymer compound having the structure shown below (viscosity average molecular weight: 40,000) are heated and dissolved in 35 parts by weight of chlorobenzene, and then the solution is returned to room temperature (25° C.). This coating liquid is applied on the charge generating layer by a dip coating method, and is heated for 60 minutes at 130° C. Thus, a charge transport layer having a thickness of 20 μm is formed.

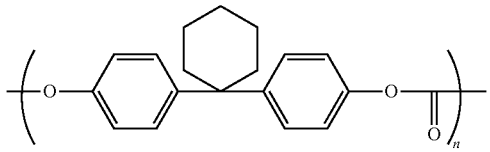

Bisphenol (Z) polymer compound

Example 2 to Example 12

Image holding members for image forming apparatuses are prepared in the same manner as in Example 1, except that the polymer compound 15, the monomer compound 15, the polymer compound 17, the monomer compound 24, the polymer compound 27, the monomer compound 23, the polymer compound 26, the monomer compound 16, the polymer compound 18, the monomer compound 22, and the polymer compound 25 are respectively used instead of the monomer compound 14 used in Example 1.

Example 13

An image holding member for an image forming apparatus is prepared in the same manner as in Example 1, except that hydroxygallium phthalocyanine crystals having strong diffraction peaks at Bragg angles (2θ±0.2°) of 7.5°, 9.9°, 12.5°, 16.3°, 18.6°, 25.1° and 28.3° in the X-ray diffraction spectrum are used instead of the chlorogallium phthalocyanine crystals used in Example 1.

Comparative Example 1

An image holding member for an image forming apparatus is prepared by the method described in Example 1, except that a compound (X) having the following structure is used instead of Specific Example compound 14 used in Example 1.

(X)

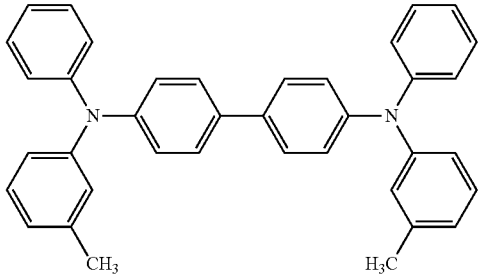

Comparative Example 2

An image holding member for an image forming apparatus is prepared by the method described in Example 1, except that a compound (XI) having the following structure (p=52) is used instead of Specific Example compound 14 used in Example 1.

(XI)

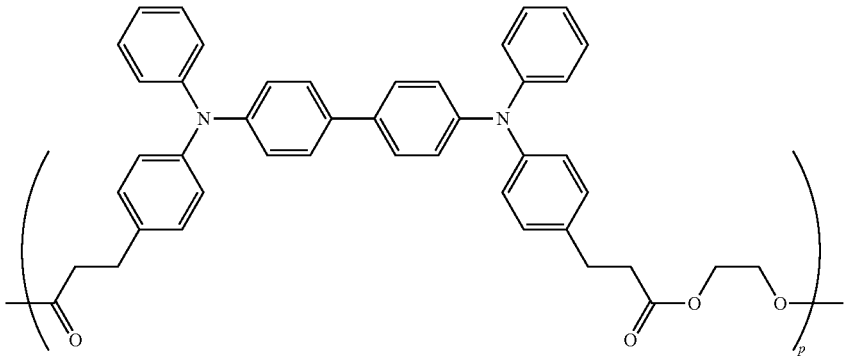

Comparative Example 3

An image holding member for an image forming apparatus is prepared by the method described in Example 1, except that a compound (XII) having the following structure is used instead of Specific Example compound 14 used in Example 1.

(XII)

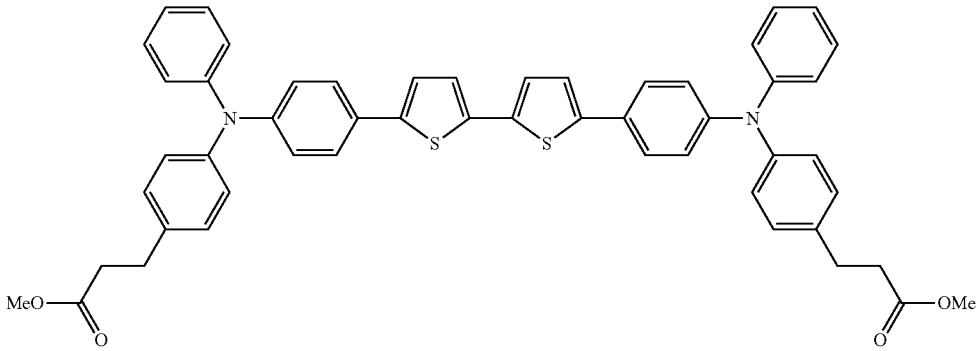

Comparative Example 4

An image holding member for an image forming apparatus is prepared by the method described in Example 1, except that a compound (XIII) having the following structure is used instead of Specific Example compound 14 used in Example 1.

(XIII)

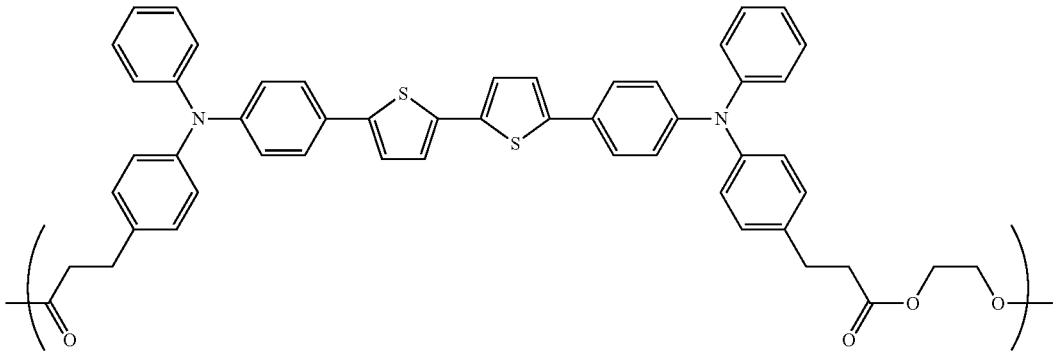

(Evaluation)

In order to evaluate electrophotographic characteristics using the respective image holding members for image forming apparatuses obtained in the Examples and Comparative Examples described above, each of the image holding members is charged by performing corona discharge at −6 kV in an environment at 20° C. and 40% RH using an electrostatic duplicating paper testing device (ELECTROSTATIC ANALYZER EPA-8100, manufactured by Kawaguchi Electric Works Co., Ltd.), and then the light of a tungsten lamp is converted to monochromatic light at 800 nm using a monochromator and is irradiated in an amount adjusted to be 1 $\mu W/cm^2$ on the surface of the photoreceptor.

Then, the surface potential $V_0$ (V) of the photoreceptor surface immediately after charging, and the half decay exposure E½ ($erg/cm^2$) at which the surface potential becomes ½×$V_0$ (V) as a result of light irradiation of the photoreceptor surface, are measured (initial characteristics). Thereafter, white light at 10 lux is irradiated for one second, and the residual potential VRP (V) remaining on the photoreceptor surface is measured (initial characteristics).

Furthermore, the values of $V_0$, E½ and VRP are measured after repeating 1000 times of the processes of charging, exposure (monochromatic light at 800 nm, the amount of exposure is the half decay exposure), and irradiation with white light (10 lux). Furthermore, the amounts of variance, $\Delta V_0$, ΔE½, and ΔVRP are evaluated (stability and durability).

Next, image forming apparatuses are prepared using the image holding members for image forming apparatuses obtained in the Examples and Comparative Examples. As elements other than the image holding member for an image forming apparatus, those mounted in a printer manufactured by Fuji Xerox Co., Ltd., DOCUCENTER C6550I, are used.

For each of the image forming apparatuses, an image forming test is carried out on 10,000 sheets (image density 10%, cyan 100%) in an environment of 28° C. and 75% RH. Meanwhile, under these test conditions, the process of each cartridge is carried out routinely, but toners of the cartridge other than the cyan toner are not used (supplied). After the test, the toner cleaning properties (staining of the charger due to poor cleaning, or deterioration of image quality), and the image quality (fine line reproducibility at 1 dot process black and a line slope of 45°) are evaluated. The methods for evaluation and the evaluation criteria for the cleaning properties and the image quality are as follows, and the obtained results are presented in Table 1.

The cleaning properties are evaluated by visual inspection, and are evaluated based on the following evaluation criteria.

A: Good

B: Partially (about 10% or less of the entirety) having streaky image defects

C: Having streaky image defects over a wide area

The image quality is examined using a magnifying glass, and is evaluated based on the following evaluation criteria.

A: Good

B: Partially having defects (no problem for practical use)

C: Having defects (fine lines are not reproduced)

TABLE 1

| | Initial characteristics (first time) | | | Maintenance characteristics | | | Stability | Durability | | | |
|---|---|---|---|---|---|---|---|---|---|---|---|
| Example | $V_0$ (V) | E1/2 ($erg/cm^2$) | VRP (V) | $V_0$ (V) | E1/2 ($erg/cm^2$) | VRP (V) | ΔE1/2 ($erg/cm^2$) | $\Delta V_0$ (V) | ΔVRP (V) | Cleaning properties | Image quality |
| Ex. 1 | −797 | 2.4 | −12 | −785 | 2.9 | −20 | 0.5 | 12 | 10 | A | A |
| Ex. 2 | −800 | 2.4 | −12 | −791 | 2.8 | −21 | 0.4 | 10 | 11 | A | A |
| Ex. 3 | −808 | 2.4 | −11 | −794 | 2.8 | −22 | 0.4 | 14 | 12 | A | B |
| Ex. 4 | −801 | 2.5 | −10 | −790 | 2.8 | −21 | 0.3 | 11 | 10 | A | A |
| Ex. 5 | −796 | 2.4 | −12 | −784 | 2.7 | −21 | 0.3 | 12 | 9 | A | A |
| Ex. 6 | −804 | 2.4 | −11 | −791 | 2.8 | −22 | 0.4 | 14 | 11 | A | B |
| Ex. 7 | −796 | 2.4 | −11 | −786 | 2.8 | −21 | 0.4 | 10 | 10 | A | A |
| Ex. 8 | −803 | 2.4 | −10 | −792 | 2.8 | −21 | 0.4 | 11 | 11 | A | A |
| Ex. 9 | −810 | 2.5 | −11 | −798 | 2.9 | −22 | 0.4 | 12 | 11 | A | A |

TABLE 1-continued

| Example | Initial characteristics (first time) $V_0$ (V) | E1/2 (erg/cm$^2$) | VRP (V) | Maintenance characteristics $V_0$ (V) | E1/2 (erg/cm$^2$) | VRP (V) | Stability ΔE1/2 (erg/cm$^2$) | Durability $\Delta V_0$ (V) | ΔVRP (V) | Cleaning properties | Image quality |
|---|---|---|---|---|---|---|---|---|---|---|---|
| Ex. 10 | −805 | 2.4 | −12 | −793 | 2.7 | −24 | 0.3 | 12 | 12 | A | A |
| Ex. 11 | −801 | 2.4 | −11 | −791 | 2.8 | −21 | 0.4 | 10 | 10 | A | A |
| Ex. 12 | −798 | 2.4 | −10 | −784 | 2.9 | −21 | 0.5 | 14 | 11 | A | B |
| Ex. 13 | −812 | 2.5 | −11 | −792 | 2.8 | −20 | 0.5 | 14 | 11 | A | A |
| Comp. Ex. 1 | −815 | 2.4 | −14 | −796 | 2.9 | −26 | 0.5 | 19 | 12 | B | C |
| Comp. Ex. 2 | −803 | 2.4 | −15 | −785 | 2.9 | −29 | 0.5 | 18 | 14 | B | C |
| Comp. Ex. 3 | −808 | 2.3 | −15 | −787 | 3.0 | −31 | 0.7 | 21 | 16 | B | C |
| Comp. Ex. 4 | −815 | 2.3 | −14 | −795 | 2.9 | −29 | 0.6 | 20 | 15 | B | C |

From the results described above, it can be seen that the image holding members for image forming apparatuses obtained in the Examples of the present invention have small variances in the residual potential due to repeated use, as compared with the Comparative Examples. Furthermore, it can be seen that the images obtained by the image forming apparatuses having the image holding members for image forming apparatuses have satisfactory image quality.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A process cartridge, comprising at least:

an image holding member that comprises a support and a photosensitive layer disposed on the support; and at least one of a developing unit that develops an electrostatic latent image to form a toner image or a cleaning unit that cleans the image holding member, wherein the photosensitive layer contains a charge generating material and a compound represented by the following formula (II-1):

Formula (II-1)

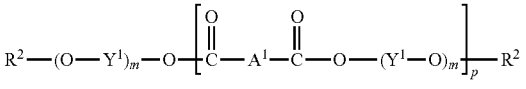

wherein in the formula (II-1), $Y^1$'s each independently represent a substituted or unsubstituted divalent hydrocarbon group; $A^1$ represents a group represented by the following formula (II-2); $R^2$'s each independently represent a hydrogen atom, an alkyl group, a substituted or unsubstituted aryl group, or a substituted or unsubstituted aralkyl group; m's each independently represent an integer of from 1 to 5; and p represents an integer of from 5 to 5,000:

(II-2)

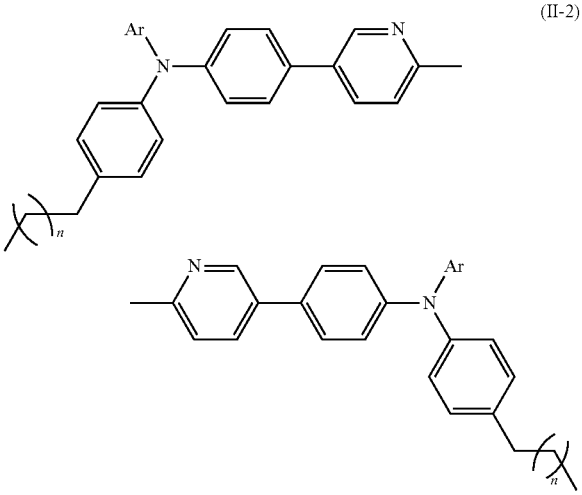

wherein in the formula (II-2), Ar's each independently represent a substituted or unsubstituted phenyl group, a substituted or unsubstituted monovalent polynuclear aromatic hydrocarbon group having two aromatic rings, a substituted or unsubstituted monovalent condensed aromatic hydrocarbon group having two or three aromatic rings, or a substituted or unsubstituted monovalent aromatic heterocyclic group; and n's each independently represent a number of from 0 to 7.

2. The process cartridge according to claim 1, comprising both the developing unit and the cleaning unit.

3. The process cartridge according to claim 2, further comprising at least one of a charging unit that charges the image holding member, an exposure unit that exposes the charged image holding member to form the electrostatic latent image, or a transfer unit that transfers the toner image to a transfer medium.

4. The process cartridge according to claim 1, wherein $R^2$'s each independently represent a hydrogen atom, an alkyl group, or a phenyl group.

5. The process cartridge according to claim 1, wherein each $R^2$ is a hydrogen atom.

6. The process cartridge according to claim 1, wherein the support is conductive, and the photosensitive layer includes an undercoat layer that is disposed on the conductive support.

7. The process cartridge according to claim 6, wherein the undercoat layer is formed by using an organozirconium compound, organotitanium compound, or organoaluminum compound, and incorporates a silane coupling agent.

8. An image forming apparatus, comprising:

an image holding member that comprises a support and a photosensitive layer disposed on the support;

a charging unit that charges the image holding member;

an exposure unit that exposes the charged image holding member to form an electrostatic latent image;

a developing unit that develops the electrostatic latent image to form a toner image; and a transfer unit that transfers the toner image to a transfer medium, wherein the photosensitive layer contains a charge generating material and a compound represented by the following formula (II-1):

Formula (II-1)

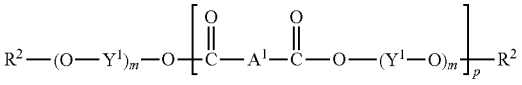

wherein in the formula (II-1), $Y^1$'s each independently represent a substituted or unsubstituted divalent hydrocarbon group; $A^1$ represents a group represented by the following formula (II-2); $R^2$'s each independently represent a hydrogen atom, an alkyl group, a substituted or unsubstituted aryl group, or a substituted or unsubstituted aralkyl group; m's each independently represent an integer of from 1 to 5; and p represents an integer of from 5 to 5,000:

(II-2)

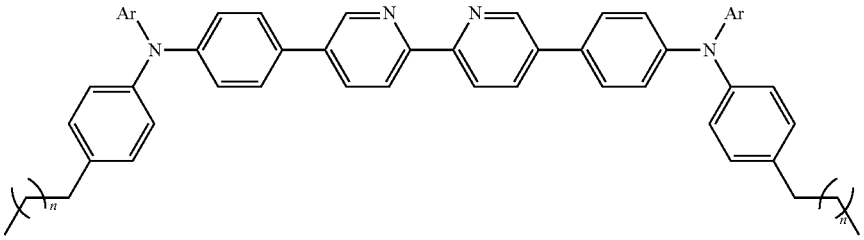

wherein in the formula (II-2), Ar's each independently represent a substituted or unsubstituted phenyl group, a substituted or unsubstituted monovalent polynuclear aromatic hydrocarbon group having two aromatic rings, a substituted or unsubstituted monovalent condensed aromatic hydrocarbon group having two or three aromatic rings, or a substituted or unsubstituted monovalent aromatic heterocyclic group; and n's each independently represent a number of from 0 to 7.

9. The image forming apparatus according to claim 8, wherein $R^2$'s each independently represent a hydrogen atom, an alkyl group, or a phenyl group.

10. The image forming apparatus according to claim 8, wherein each $R^2$ is a hydrogen atom.

11. The image forming apparatus according to claim 8, wherein the support is conductive, and the photosensitive layer includes an undercoat layer that is disposed on the conductive support.

12. The image forming apparatus according to claim 11, wherein the undercoat layer is formed by using an organozirconium compound, organotitanium compound, or organoaluminum compound, and incorporates a silane coupling agent.

* * * * *